US008789333B2

(12) United States Patent
Weber

(10) Patent No.: US 8,789,333 B2
(45) Date of Patent: Jul. 29, 2014

(54) WALL CONSTRUCTION BLOCK

(71) Applicant: Mark R. Weber, Chicago, IL (US)

(72) Inventor: Mark R. Weber, Chicago, IL (US)

( * ) Notice: Subject to any disclaimer, the term of this patent is extended or adjusted under 35 U.S.C. 154(b) by 0 days.

(21) Appl. No.: 13/958,304

(22) Filed: Aug. 2, 2013

(65) Prior Publication Data

US 2013/0312353 A1 Nov. 28, 2013

Related U.S. Application Data

(60) Division of application No. 13/773,302, filed on Feb. 21, 2013, which is a continuation-in-part of application No. PCT/US2012/051454, filed on Aug. 17, 2012, and a continuation-in-part of application No. 13/213,361, filed on Aug. 19, 2011.

(51) Int. Cl.

| | |
|---|---|
| ***E04B 1/04*** | (2006.01) |
| ***E04B 5/08*** | (2006.01) |
| ***E04B 2/32*** | (2006.01) |
| *E04B 2/18* | (2006.01) |

(52) U.S. Cl.
CPC .... *E04B 2/32* (2013.01); *E04B 2/18* (2013.01)
USPC ..... 52/569; 52/606

(58) Field of Classification Search
USPC ..... 52/561, 563, 564, 568, 70, 572, 596, 52/600, 602, 606, 607; 405/286
See application file for complete search history.

(56) References Cited

U.S. PATENT DOCUMENTS

| | | | |
|---|---|---|---|
| 1,968,393 | A | 7/1934 | Henderson |
| 4,107,894 | A | 8/1978 | Mullins |
| 4,123,881 | A | 11/1978 | Muse |
| 4,324,080 | A | 4/1982 | Mullins |
| 4,429,506 | A | 2/1984 | Henderson |
| 4,514,949 | A | 5/1985 | Crespo |

(Continued)

FOREIGN PATENT DOCUMENTS

WO 2006086626 8/2006

OTHER PUBLICATIONS

Web page at http://prostackblock.com/page2.html, 1 page, printed Sep. 13, 2011.

(Continued)

*Primary Examiner* — William Gilbert
*Assistant Examiner* — Kyle Walraed-Sullivan
(74) *Attorney, Agent, or Firm* — McCracken & Frank LLC

(57) ABSTRACT

A wall construction block includes a front surface, a back surface, an upper surface, a lower surface, and a plurality of webs extending between the front and rear surfaces to define at least one void. The front surface and back surface have first vertical ends and second vertical ends opposite the first vertical ends. The wall construction block further includes structures on the first vertical ends defining an interior protrusion and a shoulder, and structures on the second vertical ends defining an outer protrusion and a recess. The interior protrusions of the first vertical ends are adapted to interfit with the recesses on the second vertical ends of an adjacent wall construction block, and a channel is defined that extends in a height direction and is adapted to channel a fluid.

5 Claims, 23 Drawing Sheets

(56) References Cited

U.S. PATENT DOCUMENTS

| | | | | |
|---|---|---|---|---|
| 5,575,128 | A | 11/1996 | Haener | |
| 5,711,129 | A | 1/1998 | Woolford | |
| 5,715,635 | A * | 2/1998 | Sherwood | 52/286 |
| 5,881,524 | A | 3/1999 | Ellison, Jr. | |
| 5,983,585 | A | 11/1999 | Spakousky | |
| 6,065,265 | A * | 5/2000 | Stenekes | 52/604 |
| D439,678 | S | 3/2001 | Blomquist et al. | |
| 6,226,951 | B1 | 5/2001 | Azar | |
| 6,464,432 | B1 | 10/2002 | Shaw | |
| 6,488,448 | B1 | 12/2002 | Blomquist et al. | |
| 6,591,569 | B2 * | 7/2003 | Azar | 52/604 |
| 6,854,220 | B2 | 2/2005 | Dueck et al. | |
| 6,960,048 | B2 | 11/2005 | Blomquist et al. | |
| 6,990,774 | B2 | 1/2006 | Clapp | |
| 7,174,687 | B2 | 2/2007 | Ferguson | |
| 7,305,803 | B2 * | 12/2007 | Correa et al. | 52/604 |
| D591,778 | S | 5/2009 | Stephansky et al. | |
| 7,748,192 | B2 * | 7/2010 | Ryder | 52/569 |
| 7,762,033 | B2 | 7/2010 | Scott et al. | |
| 7,946,086 | B2 | 5/2011 | Hammer et al. | |
| 8,074,419 | B1 * | 12/2011 | Humphress et al. | 52/607 |
| 2007/0245673 | A1 | 10/2007 | Cerrato | |

OTHER PUBLICATIONS

Web page at http://prostackblock.com/ProStackGeneralDesignConsiderations.pdf, 1 page, printed Sep. 13, 2011.

Web page at http://haenerblock.com/pdf/2_Block_System.pdf, Haener Block 16-In Open Faced Two Block System, pp. 1-26, printed Sep. 19, 2011.

Web page at http://haenerblock.com/versatile.html, 2 pages, printed Sep. 19, 2011.

Web page at http://azarblock.com/blockopeningtxt.html, 1 page, printed Sep. 23, 2011.

Web page at http://www.azargroup.com/azarblockfiles/017_how_to_build.pdf, How to Build with Azar Mortarless Building Systems, 5 pages, printed Sep. 23, 2011.

Web page at http://azarblock.com/blockgallery/index.html, 1 page, printed Sep. 23, 2011.

Web page at http://azarblock.com/diy/whatisazarblock.html, Azar Block, Why Azar Block System Ideal fo the Do-it-Yourselfers, 1 page, printed Sep. 23, 2011.

International Search Report and Written Opinion for International Application No. PCT/US2012/051454, dated Nov. 14, 2012, Applicant, Mark Weber (11 pages).

* cited by examiner

WALL CONSTRUCTION BLOCK

CROSS REFERENCE TO RELATED APPLICATIONS

The present application comprises a divisional of U.S. patent application Ser. No. 13/773,302 filed Feb. 21, 2013, which is a continuation-in-part of International Application PCT/US12/51454 filed Aug. 17, 2012, which is a continuation-in-part of U.S. patent application Ser. No. 13/213,361, filed Aug. 19, 2011.

REFERENCE REGARDING FEDERALLY SPONSORED RESEARCH OR DEVELOPMENT

Not applicable

SEQUENTIAL LISTING

Not applicable

BACKGROUND OF THE DISCLOSURE

1. Field of the Background

The present invention generally relates to construction materials, and more particularly, to a system for constructing a wall.

2. Description of the Background

Typical concrete wall structures are fabricated using concrete masonry units (CMU's—otherwise referred to as concrete blocks) that are positioned in courses atop a foundation and joined to one another by mortar. Ordinary CMU's include planar front and rear faces and, often, two or three spaced webs extending between the front and rear faces. The webs define one or two voids extending fully from top to bottom of the CMU. Outermost webs may comprise planar or recessed end faces of the CMU. The CMU is typically formed from cast concrete or other materials.

Building a wall using CMU's is a time-consuming process that is best undertaken by a skilled tradesperson, such as a mason. Once a level foundation has been prepared, the mason must arrange CMU's in level and plumb courses. The process of building is complex because the mason must use mortar both as a positioning and bonding agent. The consistency of the uncured mortar and the strength of the mortar, when dry, have a major impact on the quality and strength of the resulting wall. Positioning accuracy during building must be constantly checked, leading to increased assembly time.

Shaw U.S. Pat. No. 6,464,432 discloses a retaining wall comprised of specialized blocks. Each block includes front, back, and two side walls that together define a void. Shaw discloses multiple embodiments, all of which include a means for interlocking adjacent blocks in the vertical and/or horizontal direction.

Blomquist et al. U.S. Pat. No. 6,488,448 discloses a retaining wall system that comprises a plurality of different sized blocks assembled together in varying combinations to construct a retaining wall. Specifically, first, second, and third blocks are all of the same width but differ in length. Further, the second and third blocks have the same height, which is different than the height of the first block. Varying combinations of the first, second, and third blocks are assembled to form six different modules all of the same height, width, and depth.

Azar U.S. Pat. No. 6,226,951 discloses a block comprising first and second congruent panels joined together by at least one web. Each panel has vertical end edges with offset notches to interfit with the end edges of an adjacent block. The offset of the notches allows any two blocks to be placed adjacent to one another without orienting either face of the block in a particular direction. Specifically, at a first end, the notch on the edge of the first panel is on the outside of the block, while the notch on the edge of the second panel at the first end is on the inside of the block. At a second end, the notch of the first panel is on the inside of the block, and the notch of the second panel of the second end is on the outside of the block. Additionally, each of the first and second panels has lower and upper surfaces, wherein the lower surface is inset slightly and the upper surface protrudes slightly. The complementary shape permits a block to interfit with another block along the upper and lower surfaces.

Crespo U.S. Pat. No. 4,514,949 discloses a metal channel leveler utilized to level and to support a wall. In the preferred embodiment, the metal channel leveler becomes part of a footing. The leveler is positioned between two parallel form boards having wall footings and receives a first course of blocks. The top elevation of the form boards are above the bottom surface of the blocks of the first course. Once concrete is poured, the footing encompasses the leveler and a bottom portion of each block of the first course. The metal channel leveler comprises a steel channel with grooves along a bottom surface, a plurality of steel angles, and a plurality of threaded leveling screws. The steel channel is supported by the steel angles perpendicular to the channel fitting into the grooves. The ends of the angles rest on the form board wall footings. Each end has a threaded leveling screw to enable the user to adjust the height and level of the channel both crosswise and lengthwise. In another embodiment, the metal channel leveler is adapted for use on a floor slab. The leveler comprises a steel channel with sides having an outer surface, a plurality of ledges on the outer surfaces of the sides of the channel, and threaded machine screws in each ledge. The height or level of the channel is adjusted by rotating the machine screws.

SUMMARY OF THE DISCLOSURE

In accordance with a further aspect of the present invention, a wall construction block combination includes a front surface, a back surface, an upper surface, a lower surface, and a plurality of webs extending between the front surface and the back surface to define at least one void with a void perimeter, wherein the at least one void is at least partially bounded by a ledge within the void and along the void perimeter. The front surface and the back surface have first vertical ends and second vertical ends opposite the first vertical ends. The wall construction block combination also includes a first plurality of structures on the first vertical ends defining an interior protrusion and a shoulder and a second plurality of structures on the second vertical ends defining an outer protrusion and a recess. The interior protrusions of the first vertical ends are dimensioned to have an interfitting relationship with the recess on the second vertical ends of a substantially identical adjacent wall construction block and wherein a channel is defined that extends in a height direction and is adapted to channel a fluid. The wall construction block combination further includes an insert separate from the block and disposed on the ledge, the insert having a surface area dimensioned to have a portion of its perimeter supported by the ledge.

DETAILED DESCRIPTION OF THE DRAWINGS

Figure 1:
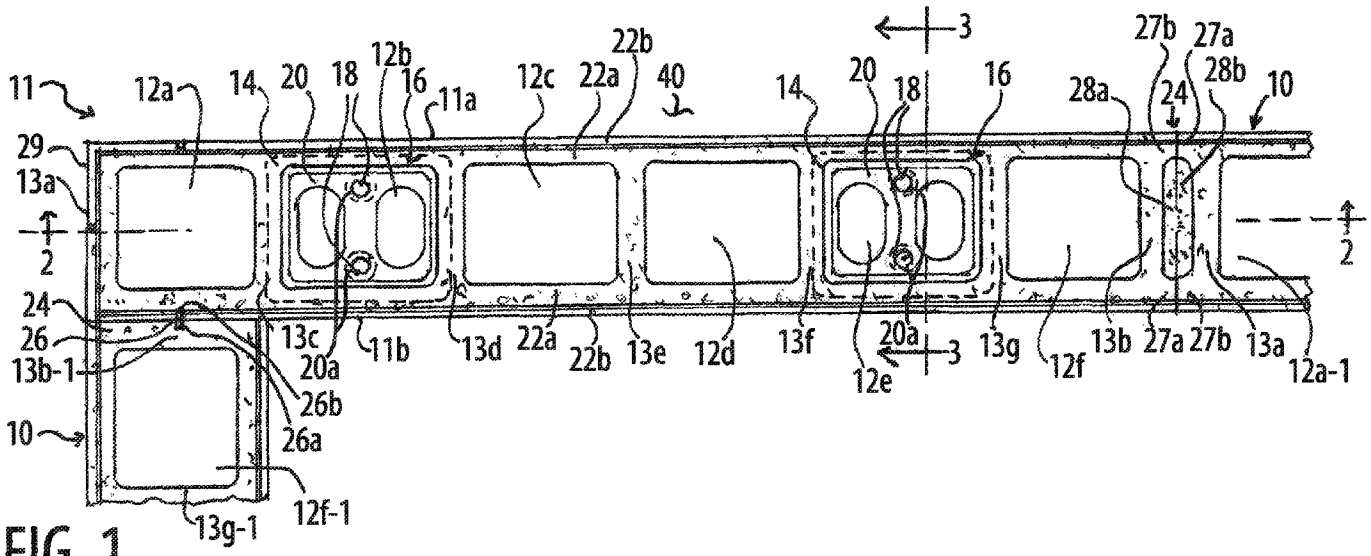
FIG. 1 is a plan view of a leveling course and one field course atop the leveling course according to a first aspect of the present invention.

As shown in the attached FIGS., the wall construction system of the present invention comprises a first course of leveling blocks and subsequent courses of field blocks, and, possibly, one or more additional courses of leveling blocks and/or beam blocks, stacked atop the first course. In the drawings, like reference numerals connote like structures throughout.

Figure 2:
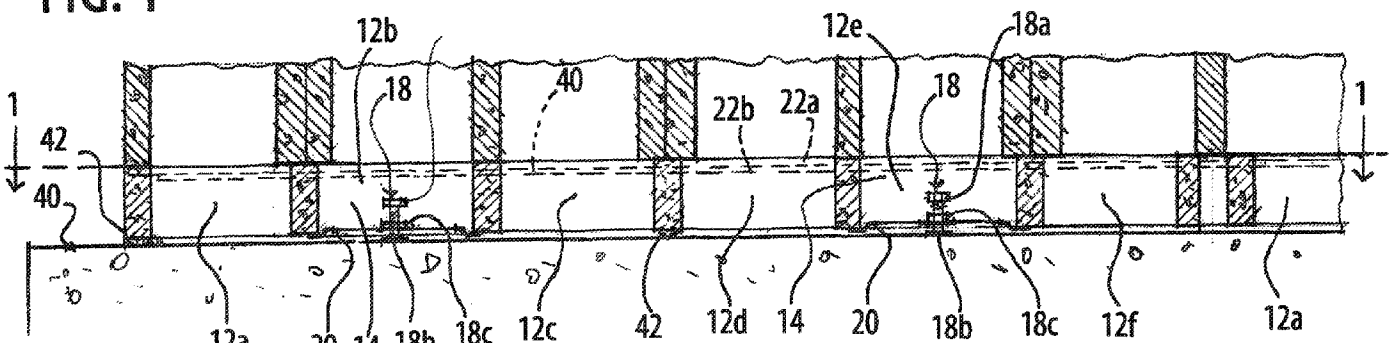
FIG. 2 is a sectional view taken generally along the lines 2-2 of FIG. 1.
Figure 3:
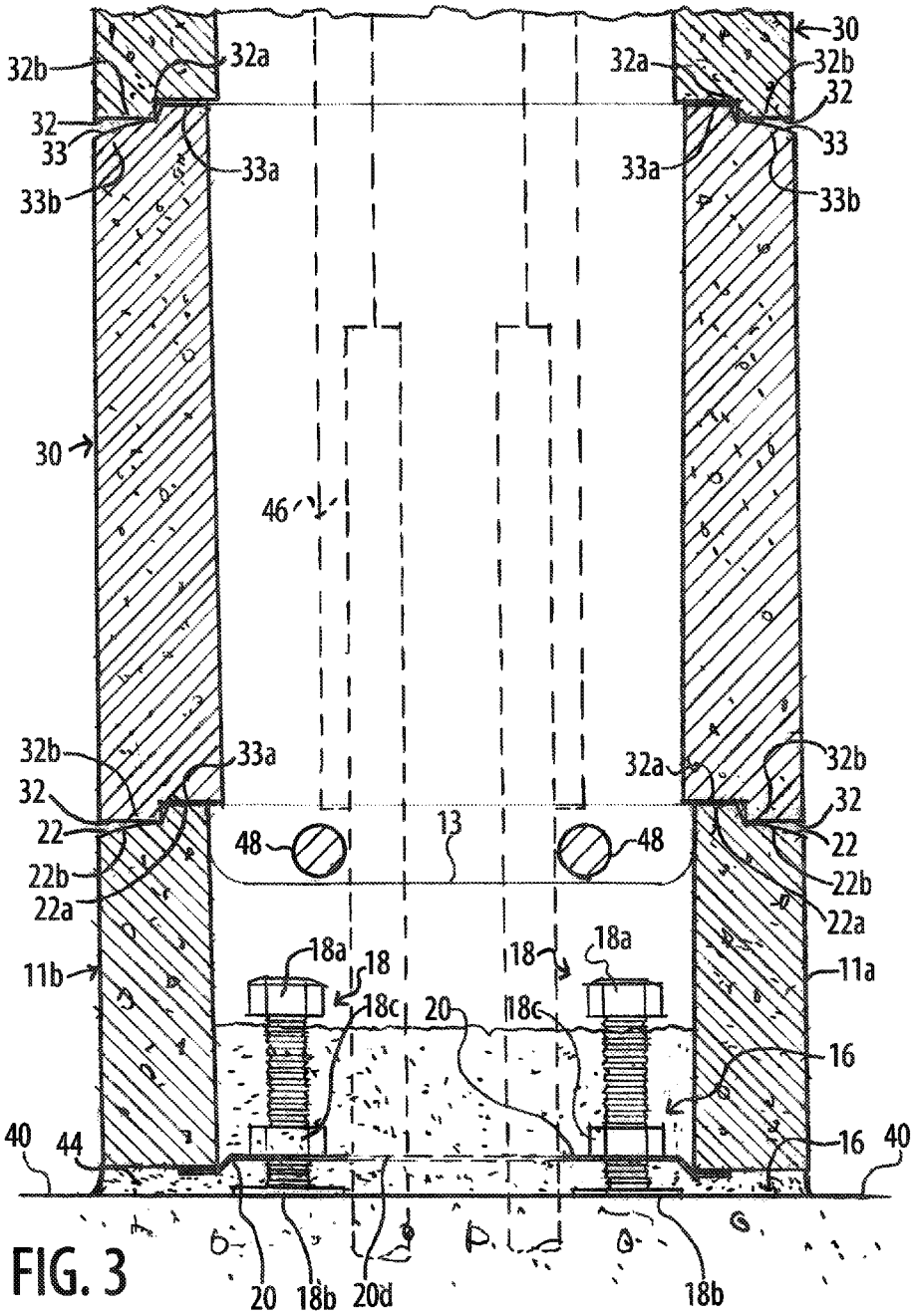
FIG. 3 is a sectional view taken generally along the lines 3-3 of FIG. 1.

As shown in FIGS. 1 through 3, the first course comprises a plurality of main leveling blocks 10 and corner leveling blocks 11 positioned end-to-end on a prepared surface 40 such as a footing. Each leveling block 10, 11 has a 4 inch or 8 inch height, a width (as measured from a front face to a rear face) of 4, 6, 8, 10, or 12 inches, and a varying length from 32 to 48 inches dependent on the width. End surfaces in the form of substantially planar side faces and webs extend between the front and rear faces. The webs and the front, rear, and the side faces define a number of voids within each block where the number of voids is dependent on the length of the leveling block. Top surfaces of the webs and the side faces are recessed 13 to receive horizontal rebar 48 (FIG. 3).

In the illustrated embodiment, the corner leveling block 11 is 32 to 48 inches in length and has six voids 12*a*-12*f* defined by end faces 13*a*, 13*b* and intermediate webs 13*c*-13*g*. (The end face 13*b* of the block 11 is recessed as shown in FIG. 1 to illustrate an alternative embodiment described in greater detail hereinafter. However, in one embodiment, the end face 13*b* of block 11 may be identical to an end face 13*b*-1 of the main leveling block 10 as seen in the left-hand portion of FIG. 1). Although not shown, the main blocks 10 also include six voids 12*a*-1-12*f*-1 defined by end faces 13*a*-1, 13*b*-1 and intermediate webs 13*c*-1-13*g*-1. The main leveling blocks 10 are otherwise similar or are identical to the corner leveling blocks 11, except that a rear face 11*b* of the corner block 11 includes a keyway for receipt of a spline as noted in greater detail hereinafter. Each of the second and fifth voids 12*b*, 12*e* of each of the leveling blocks 10, 11 (only the second and fifth voids of the block 11 are visible in FIG. 1) receives a threaded leveling component 16 that enables a user to modify the height or level of the block 10, 11 relative to the prepared surface 40. As depicted in FIGS. 1-3, each threaded leveling component 16 includes threaded adjuster bolt(s) 18 that extend through threaded bores and aligned holes in a recessed metal leveling plate 20.

In the illustrated embodiments of FIGS. 1-3, each threaded adjuster bolt 18 has a hexagonal head 18*a* at a first or upper end and a washer 18*b* having a flat surface or a cup shape at a second or lower end. The bolt extends through a nut 18*c*. The nut 18*c* is welded or otherwise secured to the leveling plate 20 adjacent and surrounding a hole 20*a* in the plate 20, and the washer 18*b* is rotatably or stationarily retained on an end of the threaded adjuster bolt 18. By turning the hexagonal head 18*a*, the threaded leveling plate 20, and correspondingly the block 10, 11, is raised or lowered relative to the prepared surface 40.

Figure 19:
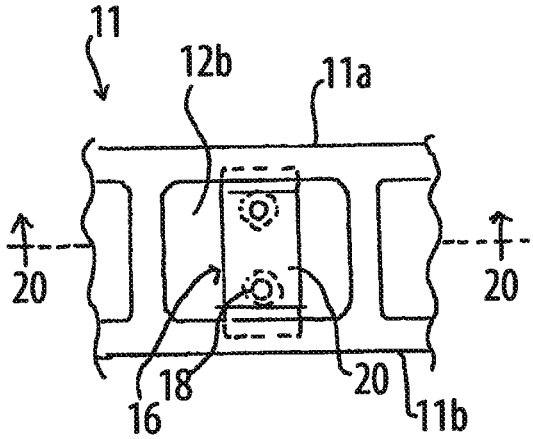
FIG. 19 is a fragmentary plan view of a further embodiment of the threaded leveling component.
Figure 20:
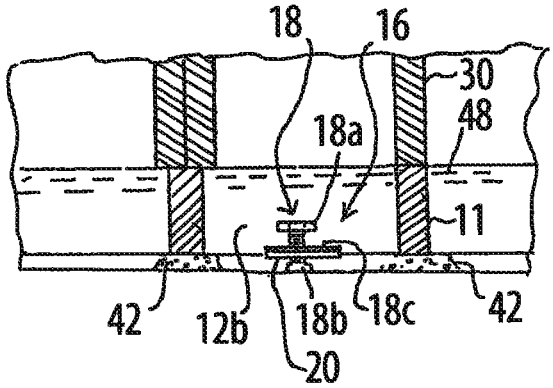
FIG. 20 is a fragmentary sectional view taken generally along the lines 20-20 of FIG. 19 illustrating the threaded leveling component of the further embodiment.
Figure 19A:
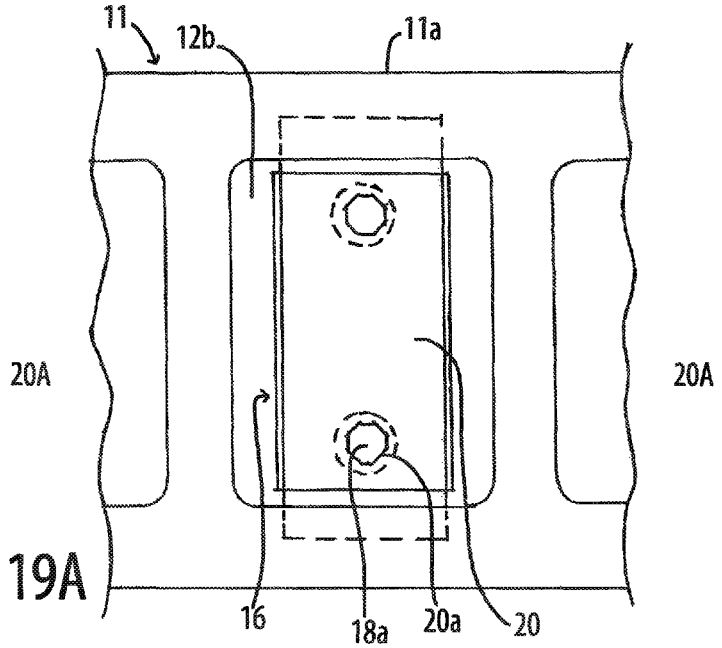
FIGS. 19A and 20A are views identical to FIGS. 19 and 20, respectively, illustrating a further embodiment of the threaded leveling component.
Figure 20A:
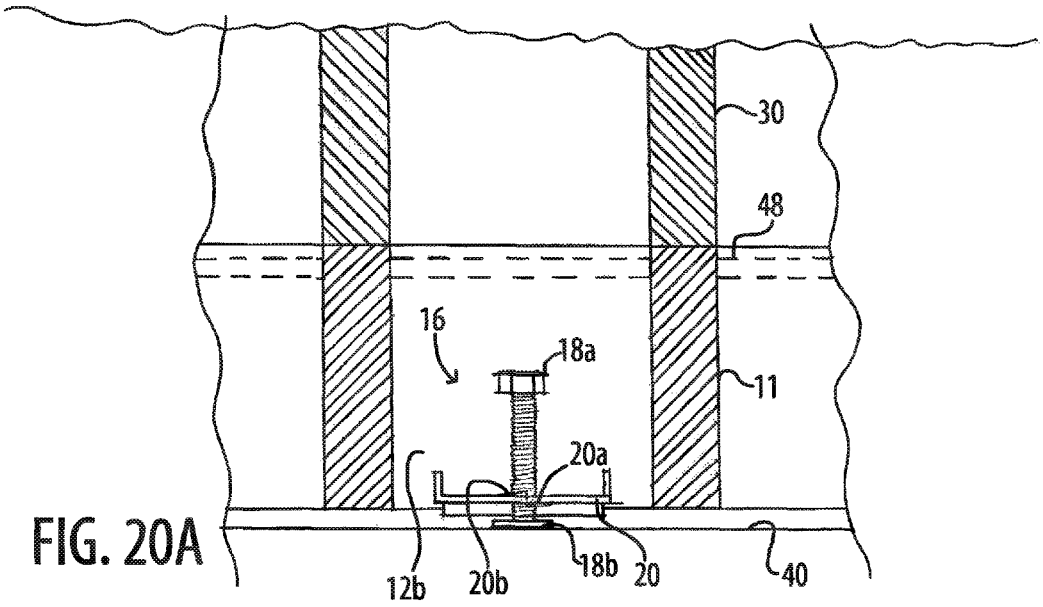

FIGS. 1-3 illustrate a first embodiment of the threaded leveling component 16 wherein the leveling plate 20 has flanges extending from each of four edges. The four flanges engage bottom surfaces of the front surface 11*a*, the rear surface 11*b*, and adjacent intermediate webs 13*c*, 13*d* and 13*f*, 13*g* of the block 11. Referring to FIGS. 19 and 20, the leveling plate 20 of a further embodiment of the threaded leveling component 16 has flanges extending from a front edge and a rear edge. The two flanges engage bottom surfaces of the front surface 11*a* and the rear surface 11*b* of the block 11. The two threaded adjuster bolts 18 of the further embodiment of the threaded leveling component 16 are positioned on a line perpendicular to the length of the block. Preferably, the further embodiment of the threaded leveling component 16 is centered between adjacent intermediate webs 13*c*, 13*d* and 13*f*, 13*g* of the block 11, although other positioning may be necessary or desirable depending on the leveled foundation and other factors. FIGS. 19A and 20A illustrate a second further embodiment of the threaded leveling component 16 that includes a threaded hole 20*a* formed by drilling and tapping holes or formed from upset and/or depressed opposed flanges 20*b* on either side of a bore, wherein the flanges 20*b* include portions that interfit with the threads of the threaded adjuster bolt 18. The threads of the holes 20*a* and/or of the bolts 18 may be self-locking to prevent each bolt 18 from unintended rotation.

Figure 21:
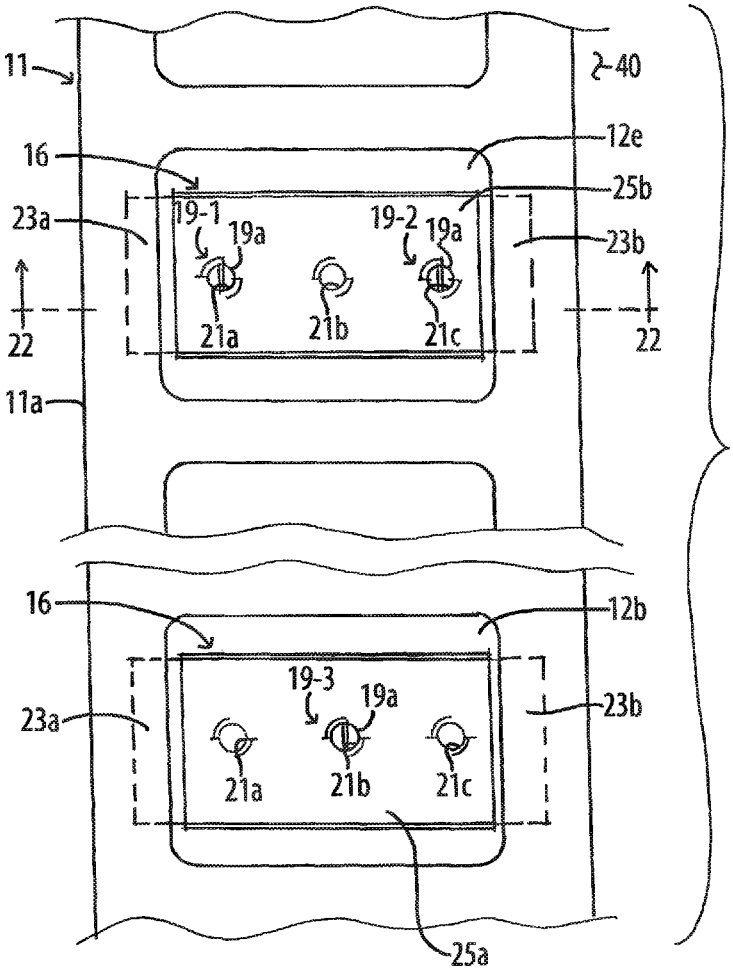
FIG. 21 is a fragmentary plan view of yet another embodiment of the threaded leveling component.
Figure 22:
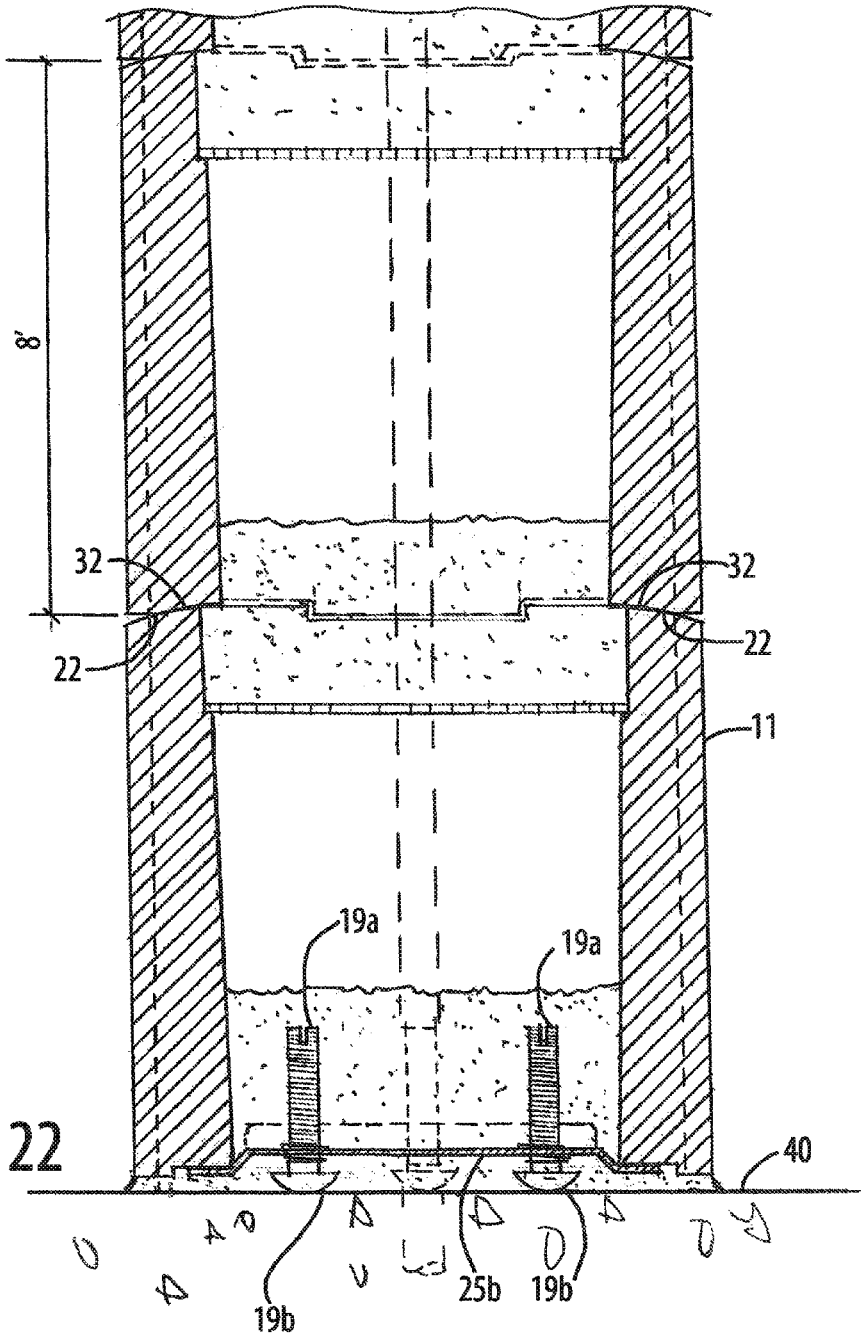
FIG. 22 is a fragmentary sectional view taken generally along the lines 22-22 of FIG. 21 illustrating the yet another embodiment of the threaded leveling component and another embodiment of a joint structure.

Alternatively, as seen in FIGS. 21 and 22, another embodiment of the threaded leveling component 16 includes a plurality of inverted carriage bolts 19 each having a slotted end 19*a* opposite a rounded head 19*b* and that may be threaded into selected bores 21*a*-21*c* of first and second spaced leveling plates 25*a*, 25*b*. The leveling plates 25*a*, 25*b* may be made of any suitable material, such as metal, and may be disposed in the second and fifth voids 12*b*, 12*e*, respectively, of each block 10, 11, or may be disposed in any other one or more voids of such blocks. Each leveling plate 25 has flanges 23*a*, 23*b* at front and rear edges, respectively, of the plate 25. The two flanges 23*a*, 23*b* engage bottom surfaces of the front surface 11*a* and the rear surface 11*b* of the block 11. Preferably, the leveling plates 25*a*, 25*b* are centered between adjacent intermediate webs 13*c*, 13*d* and 13*f*, 13*g*, respectively, of the block 11, (and corresponding adjacent intermediate webs of other blocks) although other positioning may be necessary or desirable depending on the leveled foundation and other factors.

The slotted end 19*a* of each bolt 19 is positioned at the first or upper end. The rounded head 19*b* is positioned at the second or lower end adjacent the prepared surface 40. A screwdriver or other tool may be used to turn the slotted end 19*a* such that the threaded leveling plate 25, and correspondingly the block 10, 11, is raised or lowered relative to the prepared surface 40.

Preferably, carriage bolts 19 are threaded into two of the bores 21 of one of the plates 25 and a single carriage bolt 19 is threaded into one of the bores 21 of the other plate 25. Thus, for example, bolts 19-1, 19-2 are threaded into the bores 21*a*, 21*c* of the plate 25*b* and a bolt 19-3 is threaded into the bore 21*b* of the plate 25*a*. Thus, each block 10, 11 rests on a stable tripod comprising the spaced rounded heads of the bolts 19-1 through 19-3. This allows rapid positioning and adjustment of the bolts 19 to achieve a level orientation of the blocks 10, 11 without rocking thereof. Also, it should be noted that the plates 25 may have a different number or configuration of bores 21, as desired.

Each threaded bore 21 in each leveling plate 25 may be formed by drilling and tapping holes or may be formed from upset and/or depressed opposed flanges on either side of a bore, wherein the flanges include portions that interfit with the threads of the carriage bolt 19. In any event, the threads of the bores 21 and/or of the bolts 19 may be self-locking to prevent each carriage bolt 19 from unintended rotation.

If desired, threaded adjuster bolts 18 with hexagonal heads 18*a* and a washer 18*b* as in the embodiment of FIGS. 1-3 may be substituted for the bolts 19, in which case the adjuster bolts 18 are threaded into the threaded bores 21 in the leveling plates 25. Still further, threaded adjuster bolts 18 with hexagonal heads 18*a* and a washer 18*b*, and a welded nut 18*c* as in FIGS. 1-3 may be substituted for the bolt 19 and the threaded bore 21 may be replaced by an unthreaded bore, if desired.

As seen in a first embodiment of a block profile shown in FIG. 3, first and second elongate protrusions 22*a* are formed on a top surface 22 of each leveling block 10 adjacent the voids 12 to fit securely in a corresponding recess 32*a* defined by elongate shoulders 32*b* on a bottom surface 32 of a field block 30 of a second course. The bottom surface 32 of the leveling block 10, 11 may be planar or include recesses 32*a* and elongate shoulders 32*b*. In the preferred embodiment, the protrusions 22*a* are coplanar and fully surround the voids 12; however, this need not be the case, and the protrusions 22*a* may be separated by intervening coplanar or non-coplanar element(s). Further shouldered outer portions 22*b* adjacent the top surface 22 of each of the front and rear faces slope downwardly toward the exterior of the block to allow the second course block to self-center on the lower course of blocks, and to provide both a path for water to escape and a barrier to prevent water from entering the block easily.

As shown in FIG. 1, adjacent leveling blocks 10 or 10, 11 are joined by either a spline and keyway connection 26 or cementitious material (e.g., grout or mortar) disposed in a recess 28 formed at aligned and adjacent ends of the blocks. Specifically, in one embodiment, the end faces 13*b* are planar and coincident with the end of the block. Each end face 13*b* (such as the end face 13*b*-1 of block 10) has a keyway connection 26 comprising a keyway 26*a* within which a spline 26*b* is inserted. In the case of two adjacent blocks 10, the keyway 26*a* comprises aligned grooves in the end face 13*b*-1 of one block 10 and an adjacent end face 13*a* of the adjacent block 10. In the case of adjacent blocks 10, 11, a keyway connection 26 comprises a keyway 26*a* defined by aligned grooves disposed in a rear face 11*b* of the corner block and the end face 13*b*-1 of the block 10 and a spline 26*b* is disposed in the keyway 26*a*. If desired, the keyway portion may be formed in a front face 11*a* or the end face 13*a* for connection to those portions of the block 11. In another embodiment shown in FIG. 1, adjacent end webs 13*a*, 13*b* are recessed and arms 27*a*, 27*b* extend outwardly therefrom to form end void portions 28. Ends of the arms 27*a*, 27*b* of adjacent blocks (here, the corner block 11 and the adjacent field block 10) are abutted at a joint 24 to create a void that may be filled with cementitious material.

Figure 4:
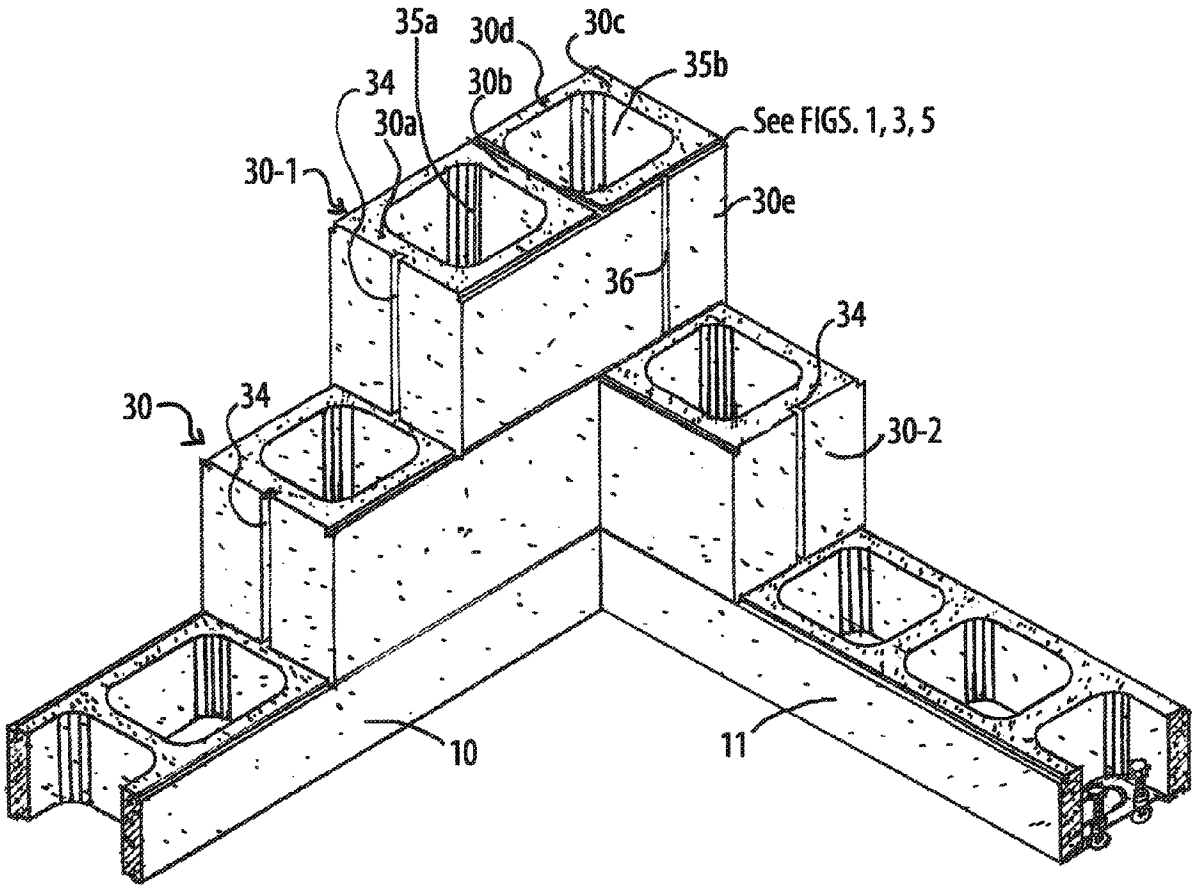
FIG. 4 is an isometric view of a corner portion of a wall using the leveling blocks of FIG. 1 together with other blocks according to another aspect of the present invention.

The concrete wall also includes a plurality of field blocks 30 as seen in FIGS. 3 and 4. Each field block 30 has an 8 inch height, a 16 inch length, and a width of 4, 6, 8, 10, or 12 inches matching the width of the leveling blocks 10, 11. Three webs 30*a*, 30*b*, 30*c* extend between front and rear faces 30*d*, 30*e* (all shown in connection with a corner field block 30-1). The webs 30*a*-30*c* and the front and rear faces 30*d*, 30*e* define a number of voids 35*a*, 35*b* within each block 30. The webs 30*a*, 30*c* comprise end surfaces in the form of substantially planar side faces of each block 30. First and second spaced elongate protrusions 33*a* are formed on a top surface 33 of each field block 30 adjacent the voids 35 to fit securely within a recess 32*a* defined by spaced elongate shoulders 32*b* on a bottom surface 32 of a field block 30 of a subsequent course (i.e., the next upper course). As with the protrusions 22*a*, the protrusions 33*a* are coplanar and completely surround the voids 35, although this need not be the case. Further shouldered outer portions 33*b* of the top surface 33 of each face slope downwardly toward the exterior of the block. Adjacent field blocks 30 are joined by either a spline and keyway connection 34 similar or identical to the connection 26 described above or a cementitious material, such as grout, disposed in a void between blocks as shown between the blocks 10 and 11 of FIG. 1 and as described above. Each of a plurality of corner field blocks 30-1, 30-2, . . . 30-*n* has a planar end face (not shown) and an additional spline and keyway connection 36 on the front or rear face 30*d*, 30*e* to key into the end face 30*a* or 30*c* of a perpendicular field block 30 (only the connection 34 of the corner block 30-1 is visible in the FIGS.).

Figure 5:
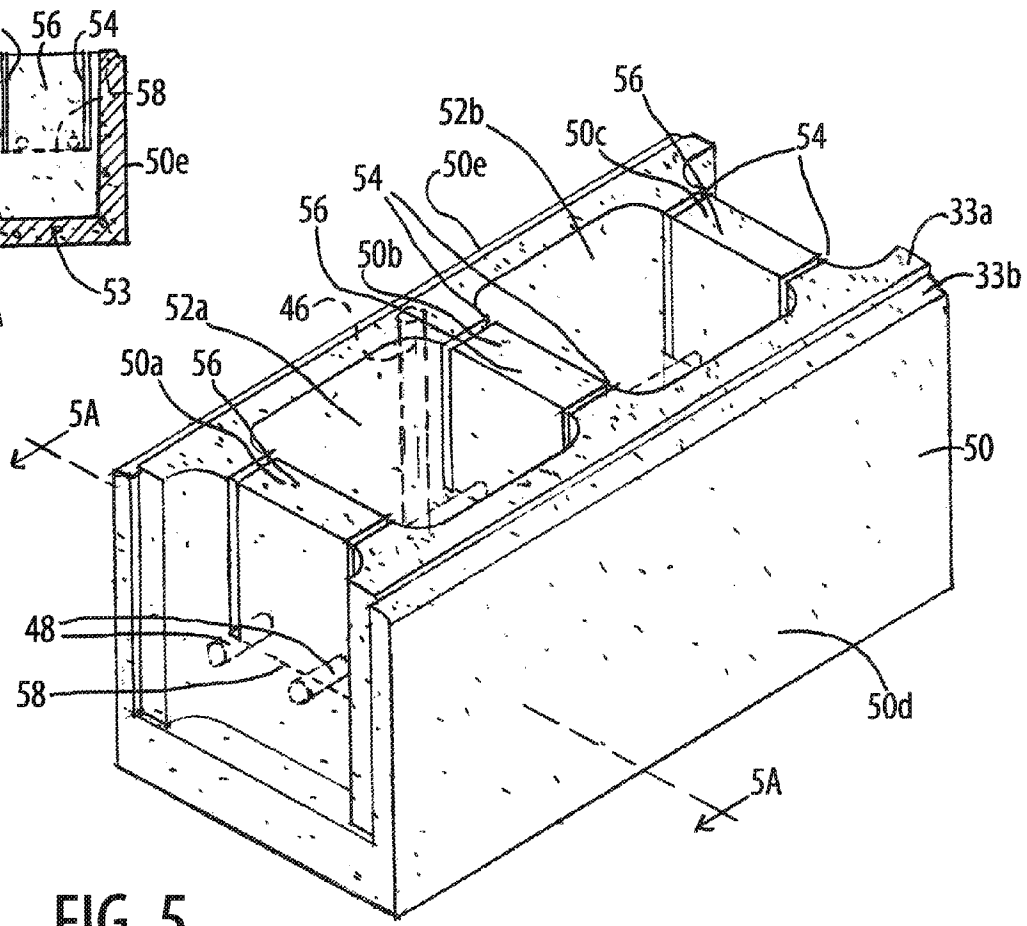
FIG. 5 is an isometric view of a beam block according to yet another aspect of the present invention.
Figure 5A:
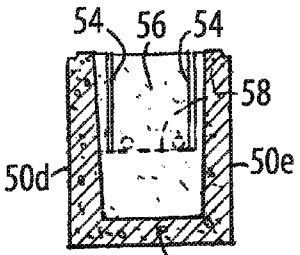
FIG. 5A is a cross sectional view taken generally along the lines 5A-5A of FIG. 5.

Additionally, a plurality of beam blocks 50 may be used to create a solid horizontal concrete beam within the wall. As shown in FIGS. 5 and 5A, each beam block 50 has an 8 inch height, a 16 inch length, and a width of 4, 6, 8, 10, or 12 inches matching the width of the leveling and field blocks 10, 30. Three webs 50*a*, 50*b*, and 50*c* extend between front and rear faces 50*d*, 50*e*. The webs 50*a*-50*c* and the front and rear faces 50*d*, 50*e* define two blind voids 52*a*, 52*b* also defined by a planar bottom surface 53 (FIG. 5A) extending fully from side to side between adjacent webs 50*a*-50*c* and between the front and rear faces 50*d*, 50*e*. Each web 50*a*-50*c* includes two slots 54 defining a frangible portion 56 therebetween. The slots 54 extend from a top surface of the web 50*a*-50*c* to approximately half the height of the block 50 and are located near the front and rear faces 50*d*, 50*e*. The user can knock out a frangible portion 56 of the webs 50*a*-50*c* as defined by the slots 54 to create a channel 58. Horizontal rebar 48 may be placed in the channel 58 and the beam blocks 50 may be filled with cementitious material (e.g., grout) to a top level of the blocks 50 to create a beam. The solid bottom surface of one or both of the blind voids 52 may also be knocked out. The voids 52 of the beam blocks 50 can be vertically aligned with the voids 12, 35 of the courses above and below to allow for vertical rebar 46 to be positioned in one or more of the aligned voids. The user can then pour cementitious material into the voids to form a solid reinforced wall section connected to the reinforced concrete beam. Similar to the leveling and field blocks, first and second spaced elongate protrusions 33*a* are formed on a top surface 33 of each beam block 50 adjacent the blind voids 52 to fit securely with a recess 32*a* defined by spaced elongate shoulders 32*b* on a bottom surface 32 of a block 10, 30 of the subsequent course above. Further shouldered outer portions 33*b* of the top surface 33 of each face of each beam block 50 slope downwardly toward the exterior of the block.

In constructing a wall, the level of the prepared surface 40 must be within a tolerance range determined by a number of leveling blocks 10 to be used and the adjustable height of the threaded leveling components 16. During or after positioning the first course of leveling blocks 10 and corner leveling blocks 11 on the prepared surface 40, the user checks the level of the blocks 10, 11 using a laser level or similar tool, and adjusts the height or level of individual blocks 10, 11 as necessary during construction by rotating the hexagonal heads 18*a* of the threaded adjuster bolts 18 or by turning the bolts 19 using a screwdriver or other tool engaged with the slotted ends 19*a*. Preferably, cementitious material is deposited into selected ones or all of the empty voids 12 and horizontal rebar 48 is positioned in the cementitious material in the recessed portion 13 atop the leveling course. Alternatively, once the first course is leveled, the user first positions horizontal rebar 48 in the recessed portion 13 atop the leveling course. The user then deposits cementitious material into selected ones or all of the empty voids 12 until the material covers the rebar 48 but before the material reaches the tops of the protrusions 22*a* of the top surface 22. In either case, the cementitious material fills any cavities 42 (FIG. 2) under the leveling blocks created by the height adjustments and forms a continuous bed of bearing surface 44 (FIG. 3). If necessary, wooden members may be used to dam the spaces below the blocks of the first course to prevent grout seepage outwardly from below the blocks.

After the cementitious material of the first course is sufficiently dry, further courses formed from a plurality of field blocks 30 are positioned atop the leveling blocks 10, 11 to form a desired pattern, such as a running bond. A course of leveling blocks 10, 11 can be utilized later during construction to relevel the wall as needed, or throughout construction of a building or structure on any structurally sound substrate such as a steel or concrete beam. In addition one or more of the blocks 10, 30, and 50 may be cut and used at a midsection of the wall to fill a gap that is less than the end-to-end dimension of a block. The voids and block dimensions of the leveling, field, and beam blocks and the pattern of laid blocks are such that the voids in the courses are preferably vertically aligned. Several courses can be laid and vertical rebar positioned in one or more of the aligned voids in the wall. Cementitious material may be poured in the voids to form a solid reinforced wall section. Additional courses can be laid atop the section as before and cementitious material poured into the aligned voids to form further reinforced wall sections until the wall is complete.

Unlike the conventional construction of cement block walls, the wall construction system of the present invention does not require a mortar setting bed to position the blocks because the protrusions 22*a*, 33*a* fit securely with the recesses 32*a* of the adjacent courses of blocks (10, 30, 50).

Figures 6, 7A:
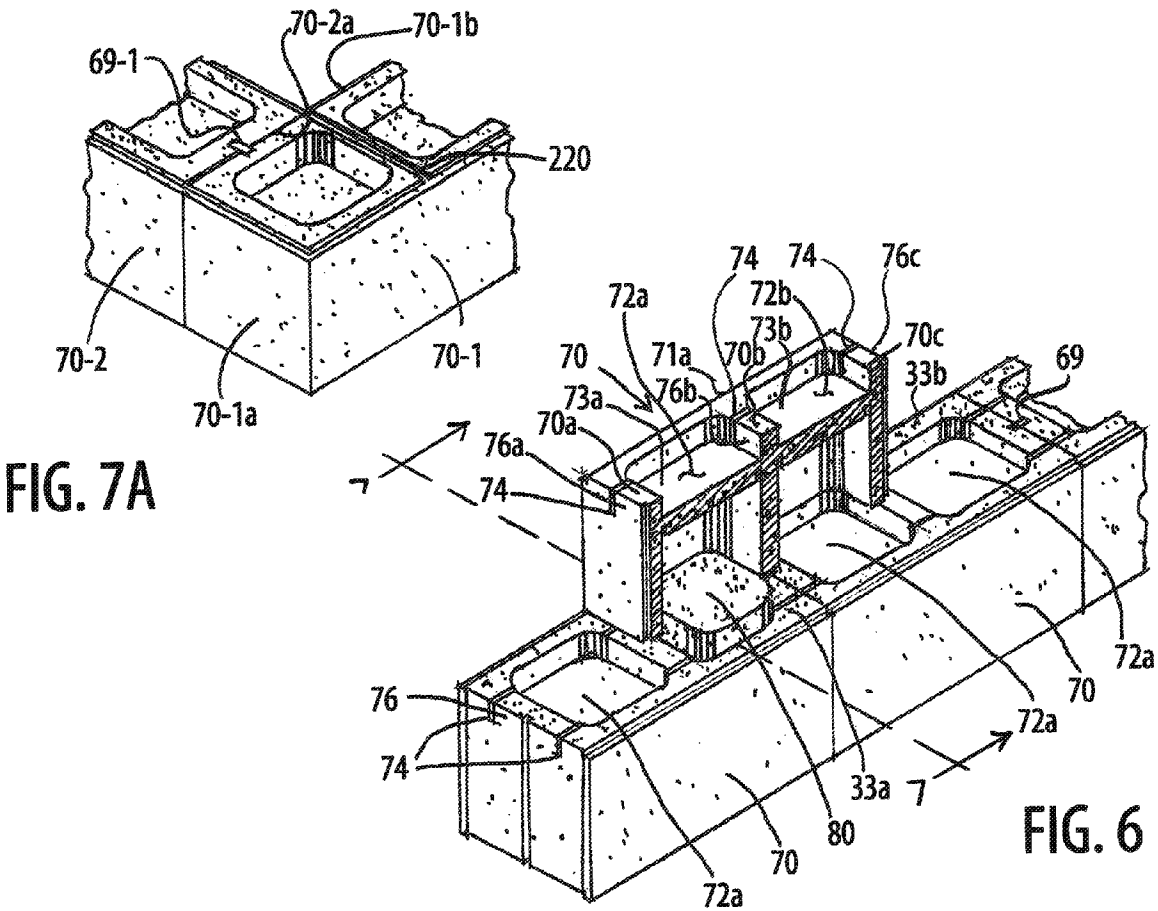
FIG. 6 is an partial isometric view, partly in section, of a wall assembled using field blocks according to still another aspect of the present invention.
FIG. 7A is a fragmentary isometric view of a portion of a corner of a wall constructed using a corner block according to one aspect of the present invention.
Figure 7:
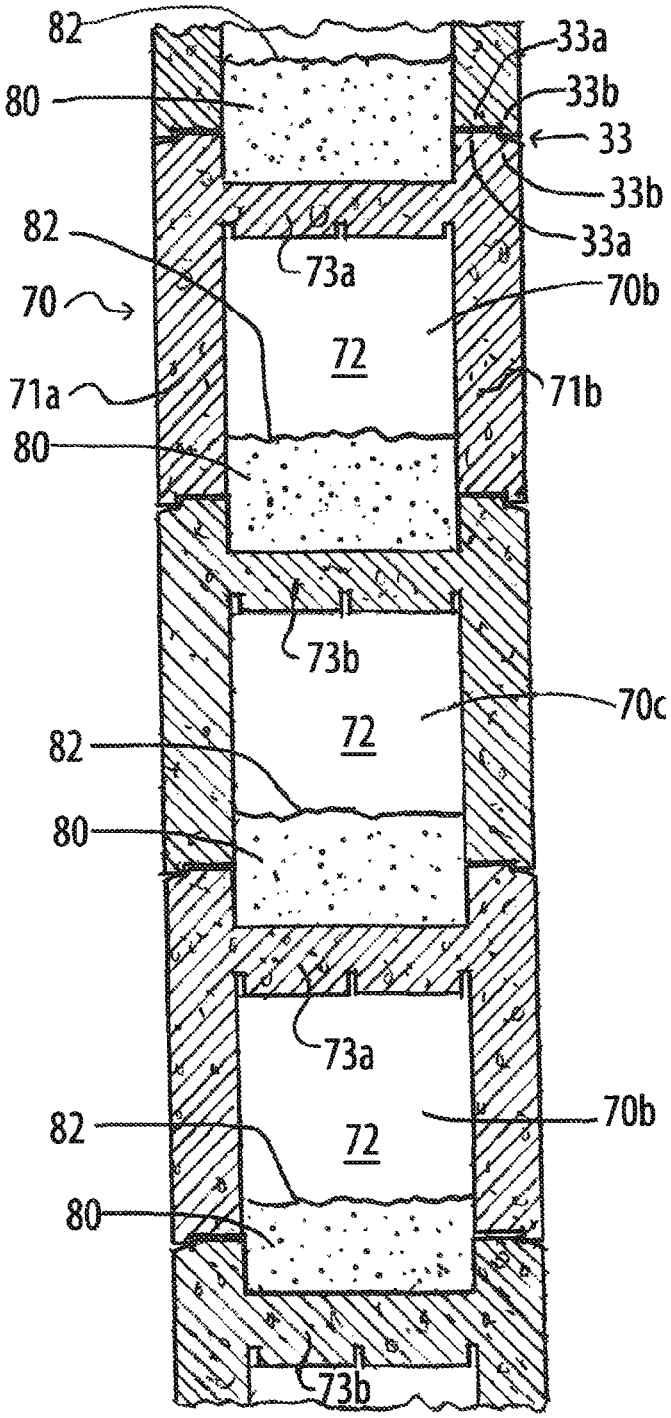
FIG. 7 is a sectional view taken generally along the lines 7-7 of FIG. 6.

The wall construction system may further include one or more other field blocks, such as a first high horizontal block 70 as seen in FIGS. 6, 7, and 7A and/or a second high horizontal block 90 as seen in FIGS. 8-14 and 18. A plurality of high horizontal blocks 70 and/or 90 may be used as a main component in the wall system similar to the field block 30 or to form a solid horizontal concrete beam within the wall similar to the beam block 50. The blocks 70 and/or 90 may be used alone as field blocks, or any or all of the blocks 10, 11, 30, 50, 70, and 90 may be used in combination to construct a wall, as desired.

Each block 70 has an 8 inch height, a 16 inch length, and a width of 4, 6, 8, 10, or 12 inches matching the width of adjacent blocks 10, 11, 30, 50, 70, and/or 90. Three webs 70*a*, 70*b*, and 70*c* extend between front and rear faces 71*a*, 71*b*. The webs 70*a*-70*c* define voids 72*a*, 72*b* within each of which is disposed a planar surface 73*a*, 73*b*, respectively, extending fully from side to side between webs 70*a*, 70*b* or between webs 70*b*, 70*c* and between the front and rear faces 71*a*, 71*b*. In any of the blocks disclosed herein, fibrous additives and/or other additives or constituents may be incorporated into the concrete during the manufacturing of the block to increase the tensile strength of the block.

Similar to the other blocks 10, 11, 30, 50 of the wall construction system, adjacent blocks 70 are joined by either a spline and keyway connection (shown, for example, as the spline and keyway connection 69 in FIG. 6) or cementitious material, such as grout, disposed in one or more voids, such as the keyway at the end(s) of the blocks 70. Referring specifically to FIG. 7A, a corner first high horizontal block 70-1 has an end surface in the form of a first planar end face 70-1*a* and may have a spline and keyway connection 69-1 on a rear face 70-1*b* to key into an end surface 70-2*a* of a perpendicular block 70-2.

Referring specifically to FIG. 7, similar to the other blocks 10, 11, 30, and 50, first and second spaced elongate protrusions 33*a* are formed on a top surface 33 of each block 70 adjacent the voids 72 to fit securely in a recess 32*a* defined by spaced elongate shoulders 32*b* on a bottom surface 32 of a block 10, 11, 30, 50, 70 of the next higher (i.e., subsequent) course. Further shouldered outer portions 33*b* of the top surface 33 of each face of each first high horizontal block 70 slope downwardly toward the exterior of the block so that water can escape from inside the blocks 70 and drain downwardly.

According to one embodiment, the top elevation of the planar surface 73*a*, 73*b* in the voids 72*a*, 72*b* is approximately one inch below the protrusion 33*a* on the top surface 33 of the block 70. Similar to each web of the beam block 50, each web 70*a*-70*c* of the block 70 includes two slots 74 defining a frangible portion 76 therebetween. The slots 74 extend from a top surface of the webs 70*a*-70*c* to the top surface of the planar surfaces 73*a*, 73*b*. The user can knock out the frangible portions 76 of the webs 70*a*-70*c* to create a channel that can be filled with horizontal rebar and cementitious material, such as grout. The planar surface 73*a* and/or 73*b* may also be knocked out and filled with cementitious material and/or rebar. For example, if the wall requires leveling during construction, a course of first high horizontal blocks 70 can be used to create a structurally sound substrate for a course of leveling blocks 10, 11. In this case, the voids 72 can be vertically aligned with the voids 12, 35, 52, 72 of the courses above and below and filled with vertical rebar 56 and cementitious material to form a solid reinforced wall section connected to the reinforced concrete beam.

When the first high horizontal block 70 is used as a main component of the wall similar to the field block 30, a plug 80 of cementitious material (e.g., grout) may be formed atop the planar surface 73*a* and/or 73*b* before the user positions an upper block 70 atop the lower block 70 during construction of the wall. Once the blocks 70 of the next course are laid, the plug(s) 80 extend upwardly into the void of the adjacent block 70 of the next course of blocks. A top surface 82 of each plug 80 after settling may be about two inches above the planar surface 73*a* and/or 73*b* and about one inch above the joint formed by the protrusion 33*a* and the bottom surface 32 of the upper block 70. Each plug 80 forms mechanical bonds along the plug/concrete interfaces and provides additional protection against the infiltration of water into the voids through joints between adjacent upper and lower blocks.

Figure 8:
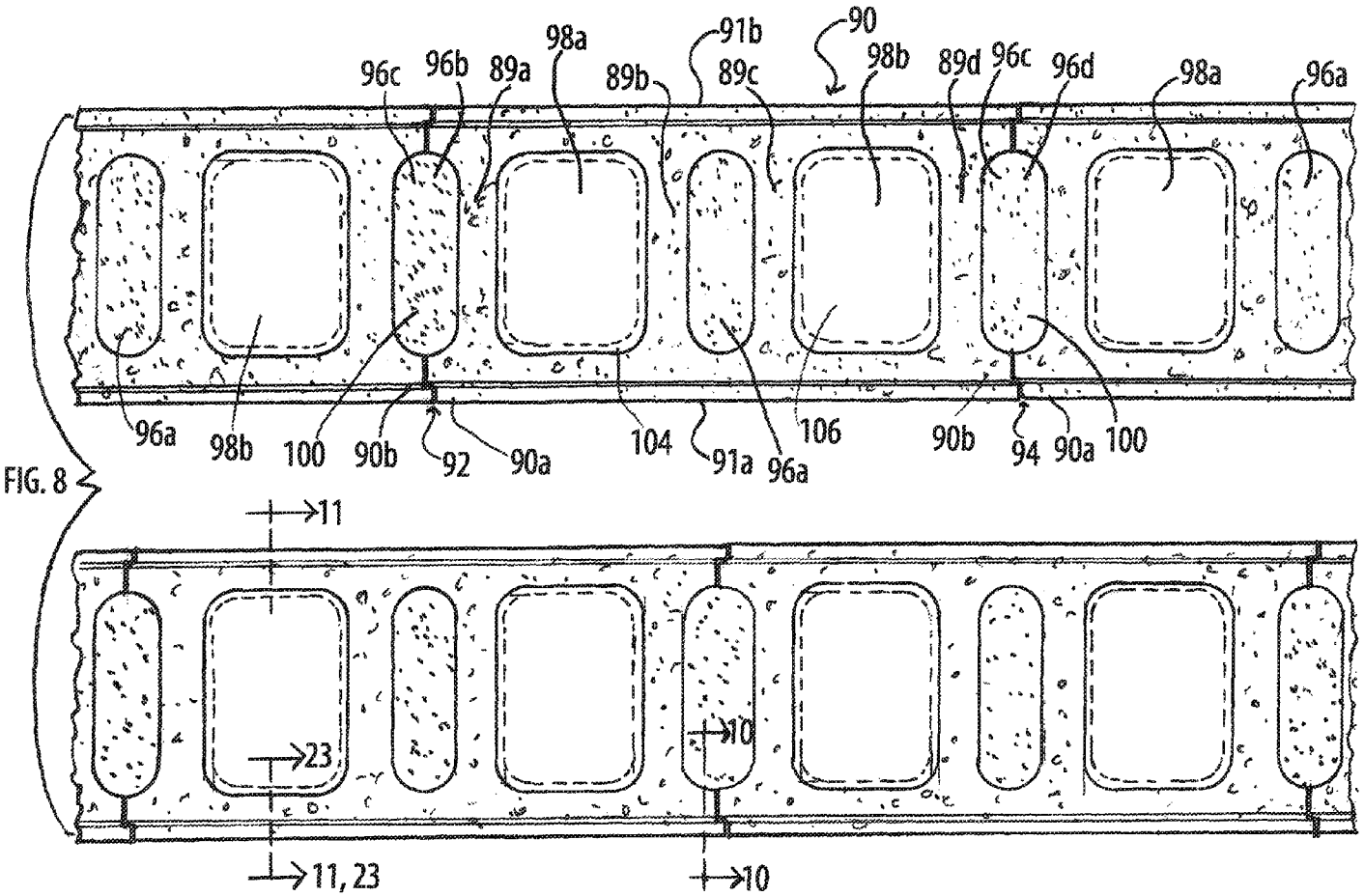
FIG. 8 is a plan view of two courses of blocks according to yet another aspect of the present invention wherein an upper course is shown at the top of the FIG. and a lower, adjacent course is shown at a bottom of the FIG.
Figure 9:
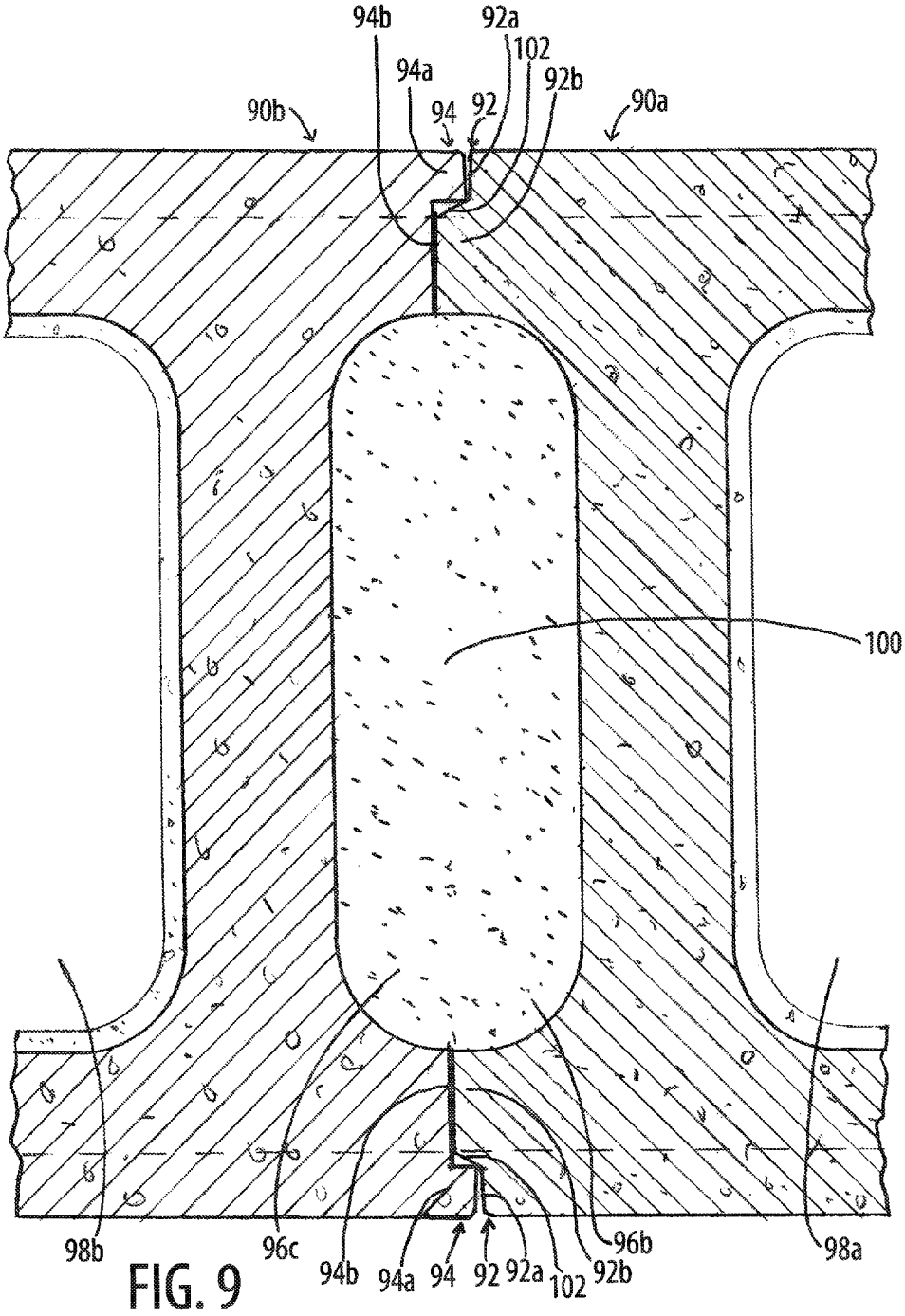
FIG. 9 is an enlarged fragmentary plan view of a portion of the upper course of FIG. 8 located within the dashed lines of such FIG.

Referring next to FIGS. 8-14, 18, 23, and 24, each second high horizontal block 90 has an 8 inch height, a 16 inch length, and a width of 4, 6, 8, 10, or 12 inches, as desired. Four webs 89*a*, 89*b*, 89*c*, 89*d* (shown in the upper course of FIG. 8) extend between front and rear faces 91*a*, 91*b* and, when the block is to be used at other than a corner of a wall, the front and rear faces 91*a*, 91*b* include two pairs of shouldered vertical end portions 92, 94 (FIG. 9). The webs 89 and the front and rear faces 91*a*, 91*b* define first and second pluralities of field block voids 96, 98, respectively, within each block. The first plurality of field block voids 96 includes a central void 96*a* and at least one end void 96*b*. More specifically, when the block 90 is to be used at other than a corner of the wall, the first plurality of field block voids preferably includes two end voids 96*b*, 96*c* disposed at opposite ends of the block 90. Each of the end voids 96*b*, 96*c* preferably is approximately one-half the longitudinal dimension (i.e., the left-to-right dimension as seen in the upper course of FIG. 8) of the void 96*a* and is approximately equal to the lateral dimension (i.e., the top-to bottom dimension as seen in FIG. 8) of the void 96*a*. Accordingly, each end void 96*b*, 96*c* is approximately one-half the size of the central void 96*a*.

Figure 10:
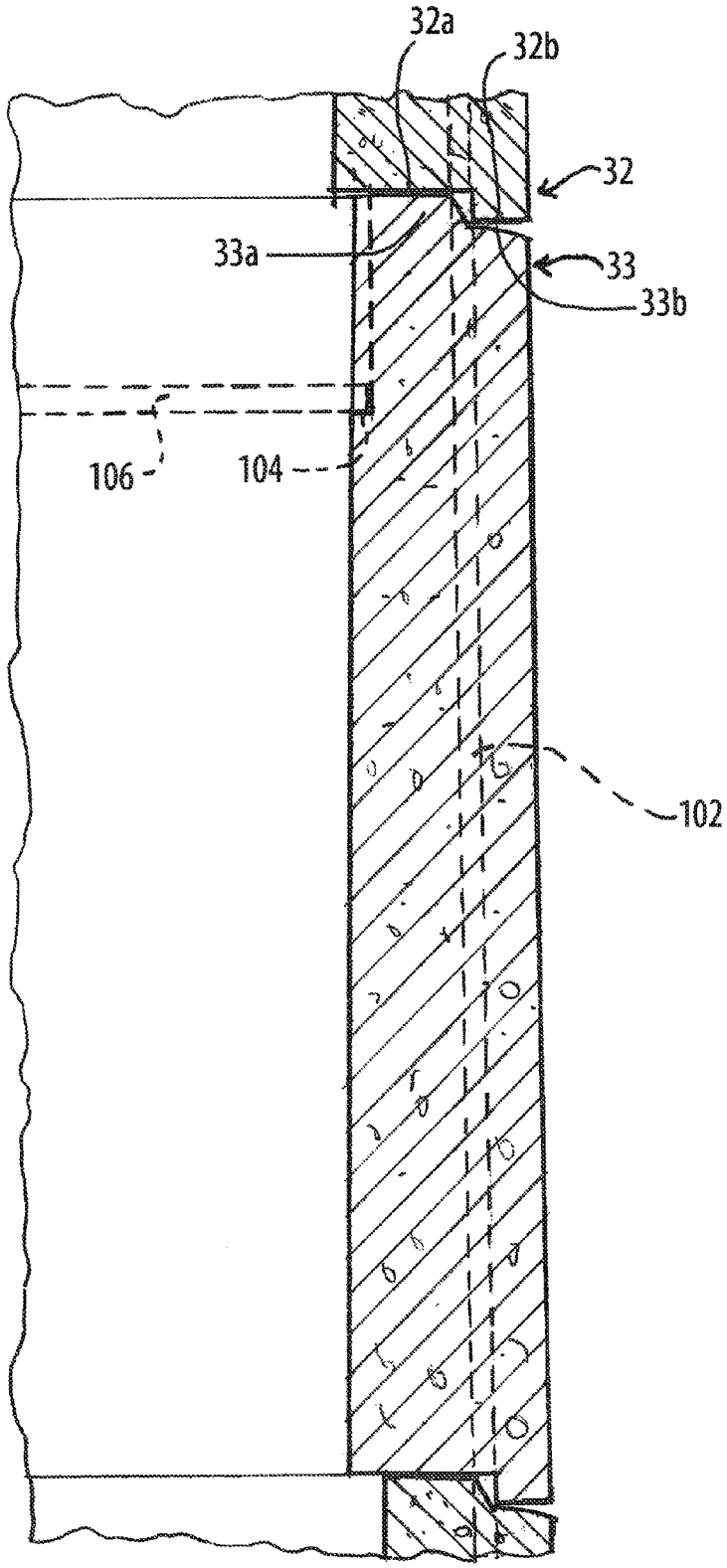
FIG. 10 is a fragmentary sectional view taken generally along the lines 10-10 of FIG. 8.

The end voids 96*b*, 96*c* are disposed at end surfaces between the pair of shouldered vertical end portions 92 and the pair of shouldered vertical end portions 94, respectively. Referring specifically to FIG. 9, each shouldered vertical end portion 92 includes a shoulder 92*a* and an interior protrusion 92*b* adjacent to the void at a first end 90*a* of one of the blocks 90. Each shouldered vertical end portion includes an outer protrusion 94*a* to define a recess 94*b* adjacent to the cavity 100 at a second end 90*b* of the block 90. The interior protrusions 92*b* of one block 90 fit within the recess 94*b* at the second end 90*b* of an adjacent block 90 so that the end voids 96*b*, 96*c* are adjacent and aligned with one another to form composite cavities or voids 100. Channels 102 are preferably defined between the interior protrusions 92*b* of the one block 90 and the outer protrusions 94*a* of the adjacent block 90 as seen in FIGS. 9 and 10. The channels 102 provide paths for water to travel downwardly along the wall and escape.

Figure 18:
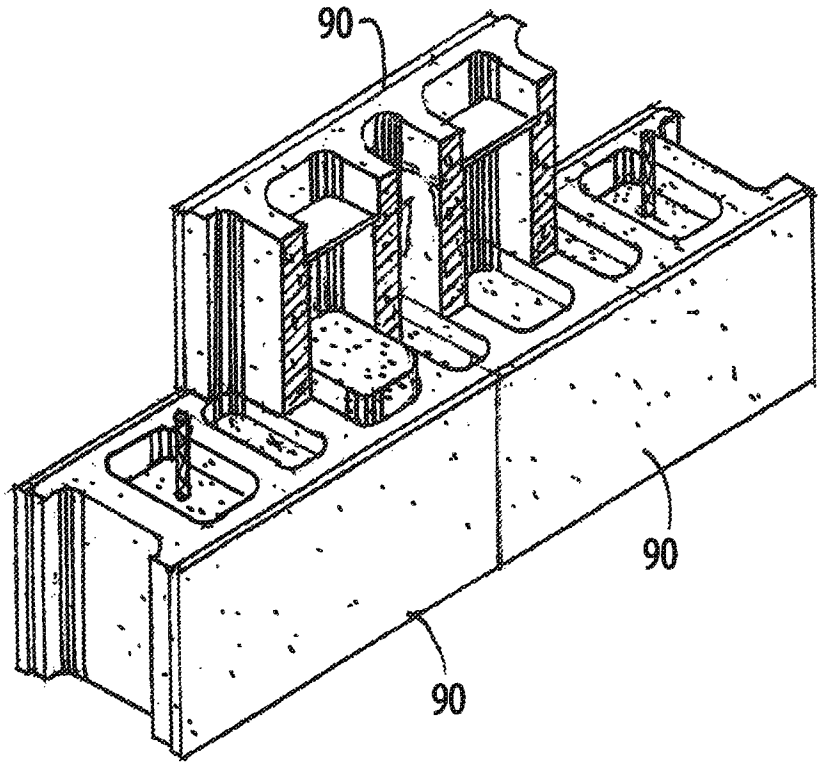

As should be evident from the foregoing, each of the composite cavities or voids 100 is preferably about the same dimensions and shape as the void 96*a*. As noted hereinafter, a cementitious material such as grout is disposed in one or more of the cavities 100 as seen in FIGS. 8, 9, and 18. If desired, adjacent blocks may alternatively have planar or other ends and be joined by a spline and keyway connection.

As shown in FIG. 10, identical or similar to the blocks 70 first and second elongate spaced protrusions 33*a* are formed on a top surface 33 of each block 90 adjacent the voids 96, 98 to fit securely in a recess 32*a* defined by spaced elongate shoulders 32*b* on a bottom surface 32 of a block 10, 11, 30, 50, 70, 90 of the subsequent (i.e., next higher) course. Further shouldered outer portions 33*b* of the top surface 33 of each face of each block 90 slope downwardly toward the exterior of the block to promote moisture escape and drainage.

Figure 11:
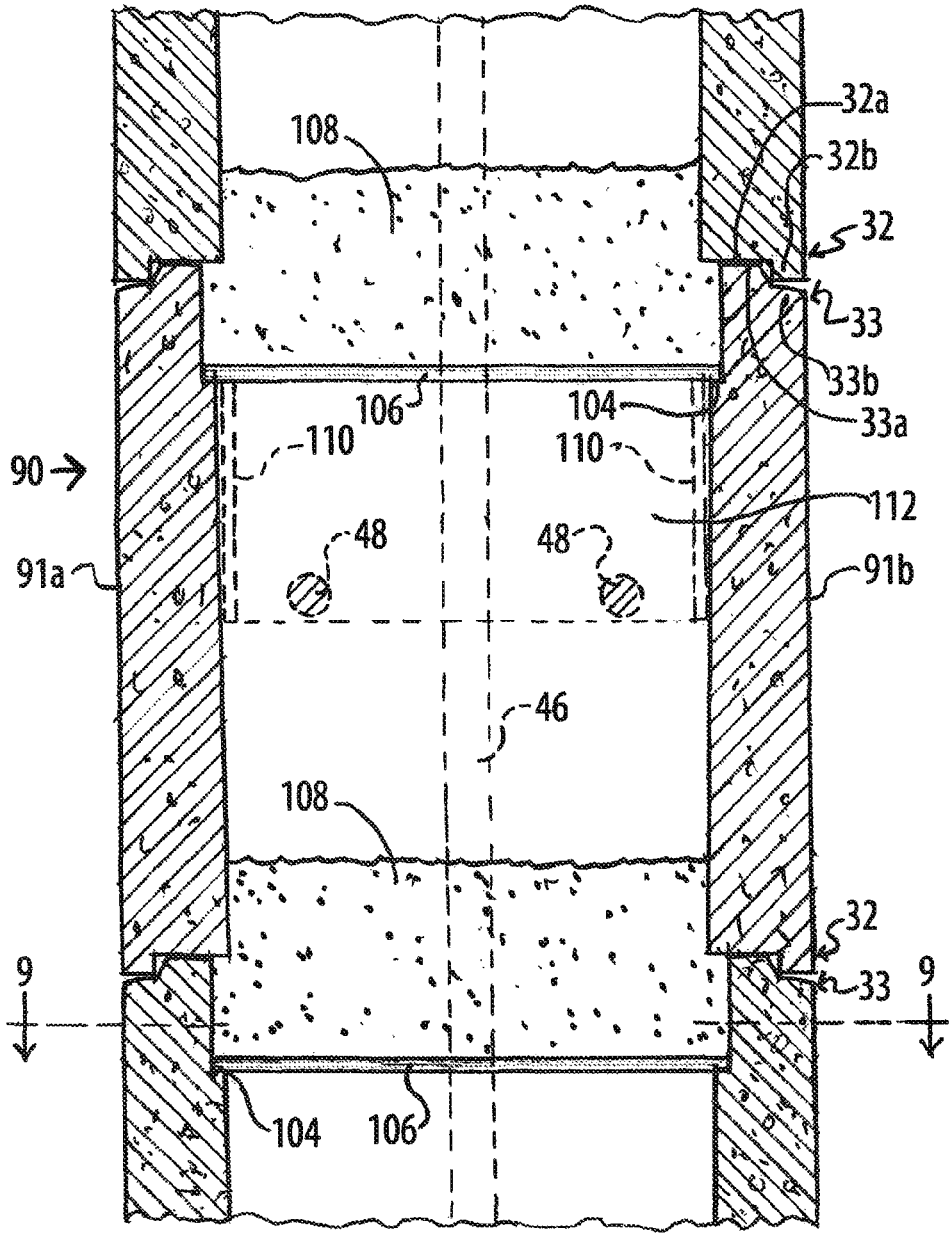
FIG. 11 is a sectional view taken generally along the lines 11-11 of FIG. 8.

Referring again to FIGS. 8-14, the plurality of voids 98 includes a pair of approximately equally sized and equally shaped voids 98*a*, 98*b*. Referring to FIGS. 11 and 18, the inner peripheries of the surfaces forming each void 98*a*, 98*b* are stepped to define a ledge 104 therein. According to an embodiment, the ledge 104 is approximately 1⅝ inch below the protrusion 33*a* on the top surface 33 of the block 90. An insert 106 may be positioned atop the ledge 104 spanning the void 98*a* and/or 98*b* fully from side to side and between the front and rear faces (an insert 106 is shown in the void 98*b* but not in the void 98*a* of the upper course of FIG. 8 for illustration purposes). The insert 106 may be planar or a different shape (such as convex or concave) and may also have a hole or crossing slots or the like in which vertical rebar 46 may be inserted. The insert may be plastic or a similar material that is sufficiently durable to hold uncured grout until curing is complete, and may be approximately 3⁄16 inch thick.

Similar to the block 70, a plug 108 of cementitious material, such as grout, may be formed atop the insert 106 before the user positions an upper block, for example, another block 90, atop the lower block 90 during construction of the wall. Once the blocks of the next course are laid, the plug 108 extends upwardly into the void 96, 98 of the adjacent block of the next course. Alternatively, inserts 106 may be placed in one or more voids 98 of blocks 90 of a lower course and the blocks (e.g., the blocks 90) of the next course may be laid atop the lower course of blocks 90 before plug(s) 108 are formed in the lower course of blocks 90. Cementitious material, such as grout, may be poured in aligned voids in upper and lower blocks in the successive courses before insert(s) 106 are placed in the one or more void(s) 98 in the blocks 90 of the upper course. In either event, the top elevation of the plug 108 after settling is preferably about two inches above the insert 106 and about one inch above the joint formed by the protrusion 33*a* of the blocks 90 of the lower course and the bottom surface of the upper block of adjacent courses.

If desired, one or more of the end voids defining the composite voids 100 may have ledges and inserts on which cementitious material may be deposited.

As should be evident from the foregoing, an inherent advantage of the shouldered outer portions 33*b* of the top surface 33 of each face of each block and channels 102 is the formation of a watershed region along the exterior of the wall. The watershed region prevents the infiltration of water or any type of fluid into the voids of the block system in the event that that the block system is subjected to rainfall, spraying of water, or the like. Water that collects along the horizontal and vertical interfaces of adjacent blocks drains across shouldered outer portions 33*b* that slope downwardly toward the exterior of the block, or passes through vertical channels 102 to the next shouldered outer portion 33*b*. Further, in the first and second high horizontal blocks 70, 90, as noted above, the grout plug 80, 108 creates a barrier that prevents infiltration of water at horizontal interfaces between adjacent blocks and forces water to drain outwardly along the shouldered outer portion 33*b* toward the exterior of the block.

Figure 24:
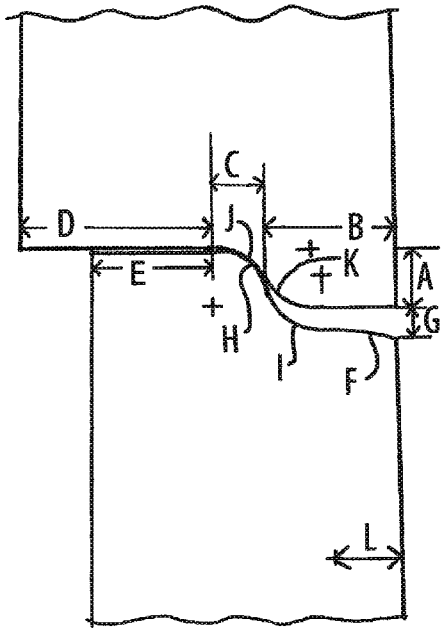
FIG. 24 is a fragmentary sectional view of the joint area of FIG. 23 showing adjacent abutting blocks and illustrating sample dimensions thereof.
Figure 23:
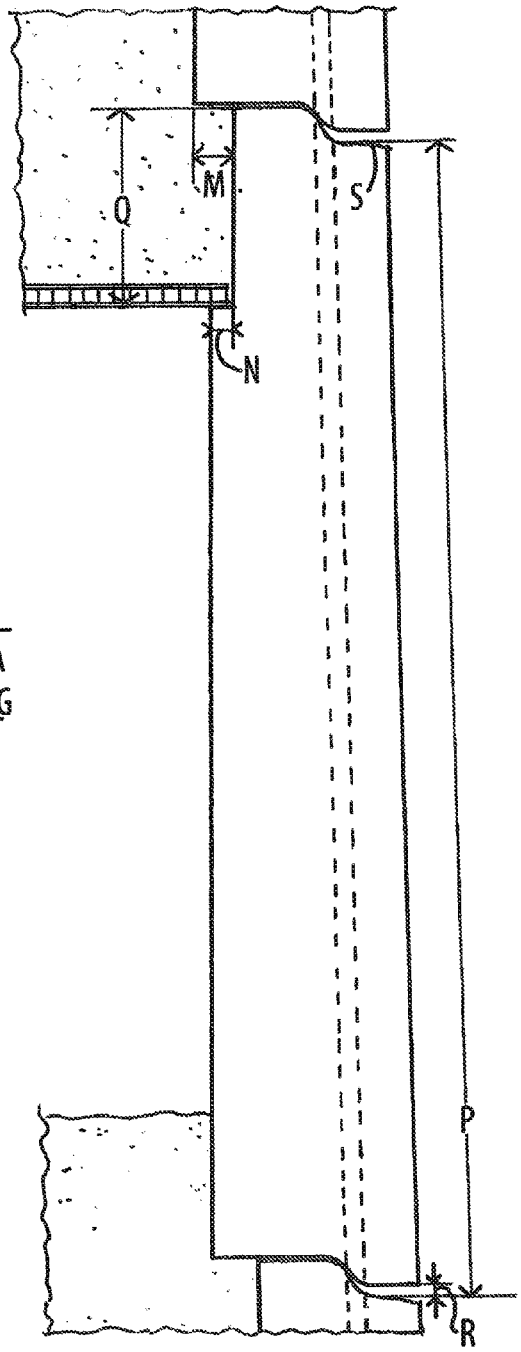
FIG. 23 is a fragmentary, sectional view taken generally along the lines 23-23 of FIG. 8.

FIGS. 23 and 24 and the table below specify preferred dimensions of the first embodiment of the profile for each block 90, it being understood that such dimensions are exemplary only and do not limit the present invention. Also, the dimensions of other blocks used in the construction of a wall are preferably (although not necessarily) similar or identical to the dimensions given in the following table with the possible exception(s) of dimension P (i.e., the height of the block) and the absence of structures defining dimensions N and Q:

| REFERENCE | NOMINAL DIMENSION (Inches - unless otherwise specified) |
|---|---|
| A | 0.1875 |
| B | 0.375 |
| C | 0.125 |
| D | 0.75 |
| E | 0.50 |
| F* | 0.21875 |
| G | 0.125 |
| H* | 0.1875 |
| I* | 0.1875 |
| J* | 0.1875 |
| K* | 0.1875 |
| L*[T] | 0.219 |
| M | 0.25 |
| N | 0.125 |
| P | 8.00 |
| Q | 1.625 |
| R | 0.125 |
| S | 0.75 |

*Radius of Curvature

[T]Dimension L refers to the distance between the center of the circle that defines the radius of curvature F and the front or rear face of the block.

In another embodiment shown in FIG. 11, each web 89 includes two slots 110 (shown in dashed lines) defining a frangible portion 112 therebetween. The slots 110 extend from a top surface 33 of the web to approximately half the height of the block 90. The user can knock out frangible portions 112 of the webs as defined by the slots 110 to create a channel. Once a lower course of blocks 90 is laid and inserts 106 positioned atop the ledges 104 thereof, an upper course of blocks 90 having the frangible portions 112 knocked out are positioned atop the lower course and horizontal rebar 48 may be placed in the resulting channel of the upper course. The blocks 90 of the upper course may be filled with cementitious material (e.g., grout) to a level at least covering the rebar 48, wherein the material rests on the inserts 106 of the lower course of the blocks 90. If the wall requires releveling during construction, a course of blocks 90 can be used to create a structurally sound substrate for a course of leveling blocks 10, 11 (and/or the leveling blocks disclosed hereinafter) by pouring cementitious material into voids of a course and leveling the material even with an upper surface of the blocks at the tops of the protrusions 33*a*.

Figure 12:
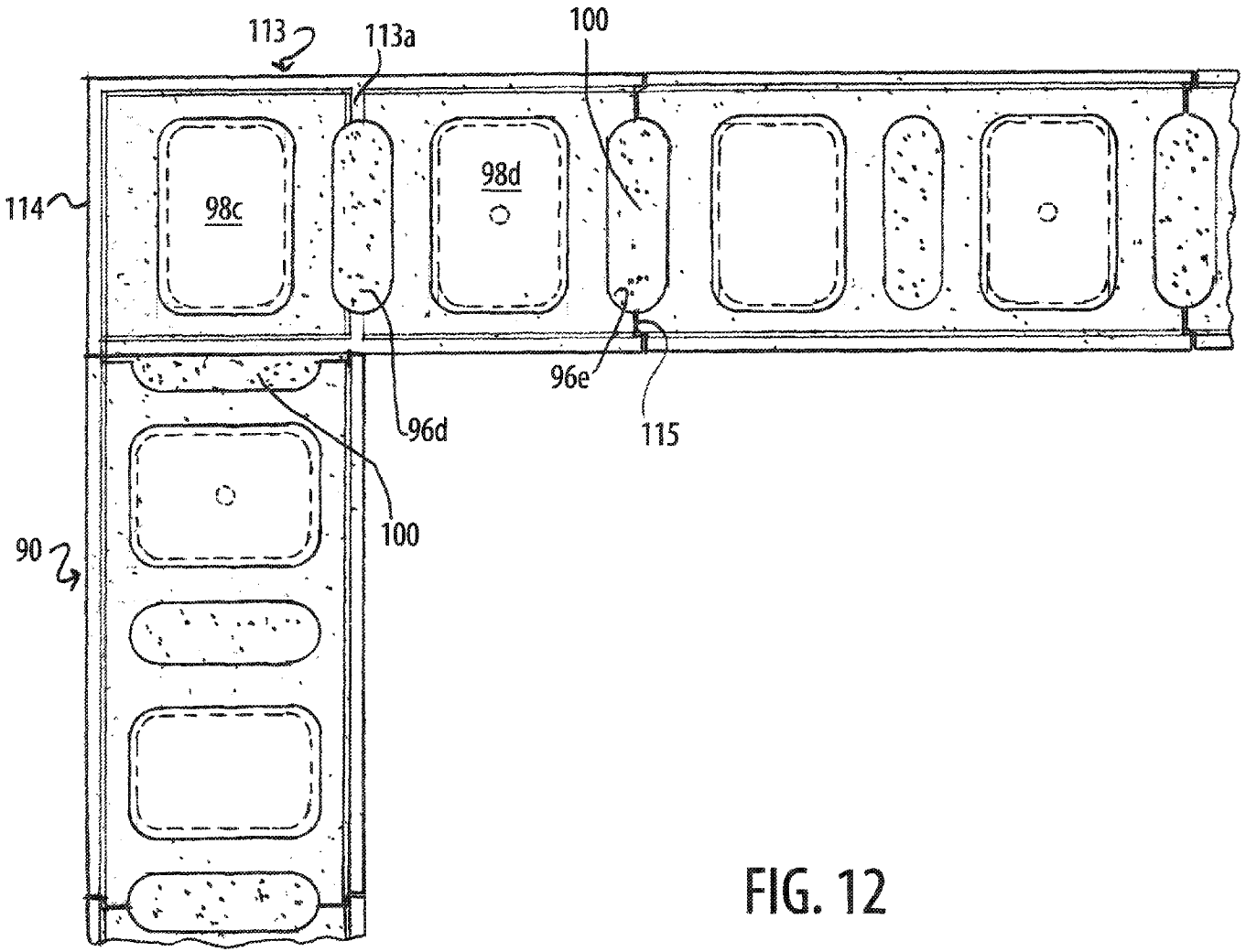
FIG. 12 is a plan view of a corner of a wall incorporating the blocks of FIG. 8.

Referring to FIG. 12, a corner second high horizontal or field block 113 has a planar side face 114 and an end face 115 defining a cavity 100. The front and rear faces of the corner block 113 are planar. The recess formed by the cavity 100 of an adjacent perpendicular block 90 adjacent the planar front or rear face of the corner block 113 is filled with cementitious material (e.g., grout). If spline and keyway connections are used, the front or rear face of the corner block has a keyway connection to key into the side face of a perpendicular adjacent block 90 (in this case the end of the adjacent block 90 next to the corner block 113 may be planar).

Further, FIG. 12 illustrates that the corner block 113 may include a void arrangement different than other blocks 90. In the illustrated embodiment the block 113 may include voids 96*d*, 96*e*, and 98*c*, 98*d*. Void 96*d* may be substantially the same size as the void 96*a*, the void 96*e* may be substantially the same size as the void 96*c* and each void 98*c*, 98*d* may be substantially the same size as the void 98*a* or 98*b*. Any or all of the voids 96*d*, 96*e*, 98*c*, 98*d* may be partially or fully filled with cementitious material and/or rebar, as necessary or desirable.

Figure 13A:
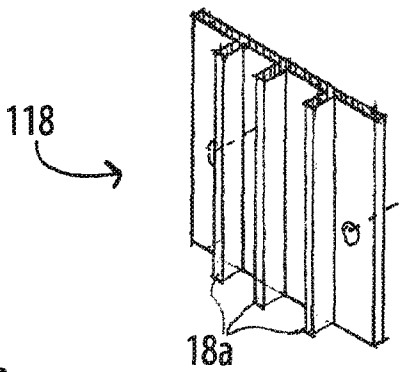
FIG. 13A is an isometric view of the plate of FIG. 13.
Figure 13:
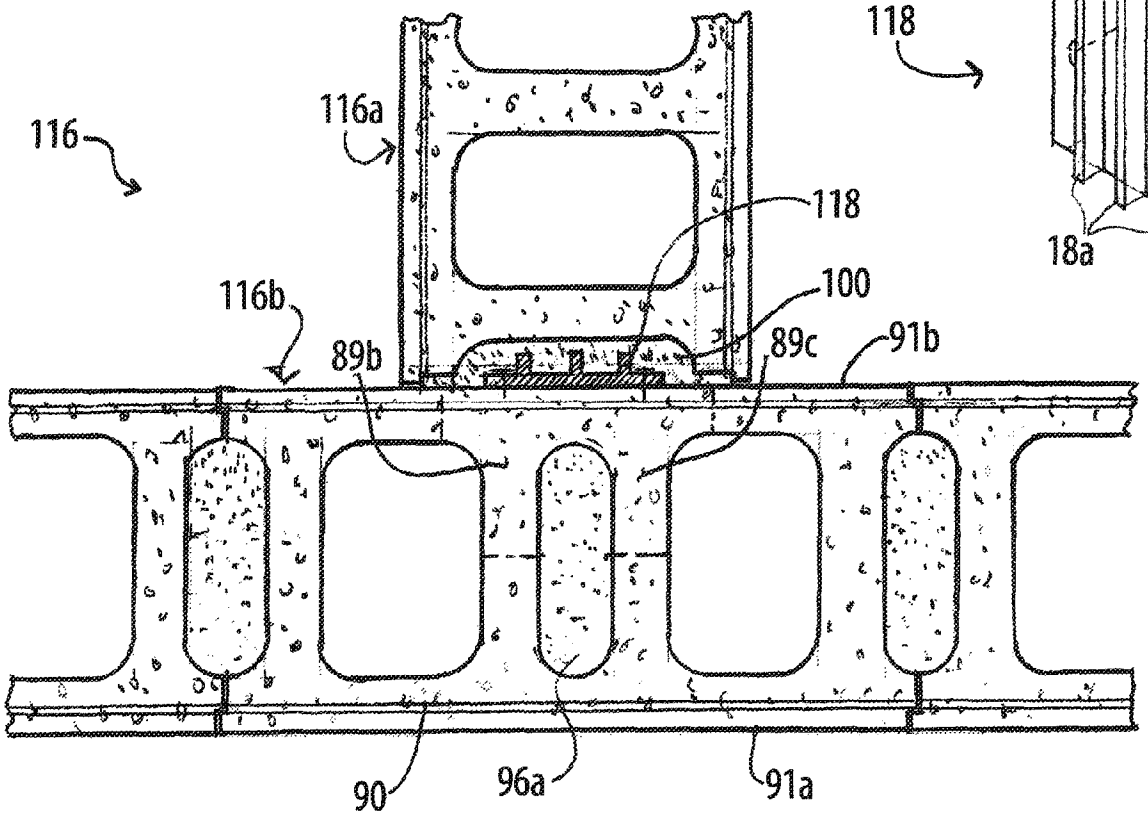
FIG. 13 is a plan view of a wall including a tee constructed using the blocks of FIG. 8.

As shown in FIG. 13, a plurality of field blocks 90 may be assembled to form a tee 116. While the tee 116 is shown as being centered on a block 90, this need not be the case, and the tee may be formed at any position on any of the blocks disclosed herein. A block 116*a* is positioned perpendicular to a block 116*b* so that the cavity 100 of the block 116*a* is centered on the central void 96*a* of the block 116*b*. Portions of the web 89*b* and/or 89*c* and the front or rear face 91*a*, 91*b* of the block 116*b* between the central void 96*a* of the block 116*b* and the cavity 100 of the block 116*a* (here shown as the rear face 91*b*) may be removed to form a larger cavity that may be filled with cementitious material. Alternatively, a plate 118 (also seen in FIG. 13A) having one or more extensions 118*a* may be screwed into or otherwise affixed to the face of the block 116*b* adjacent the cavity 100 of the block 116*a*. The plate 118 with extensions 118*a* increases the surface area to which the cementitious material can bond.

Figure 14:
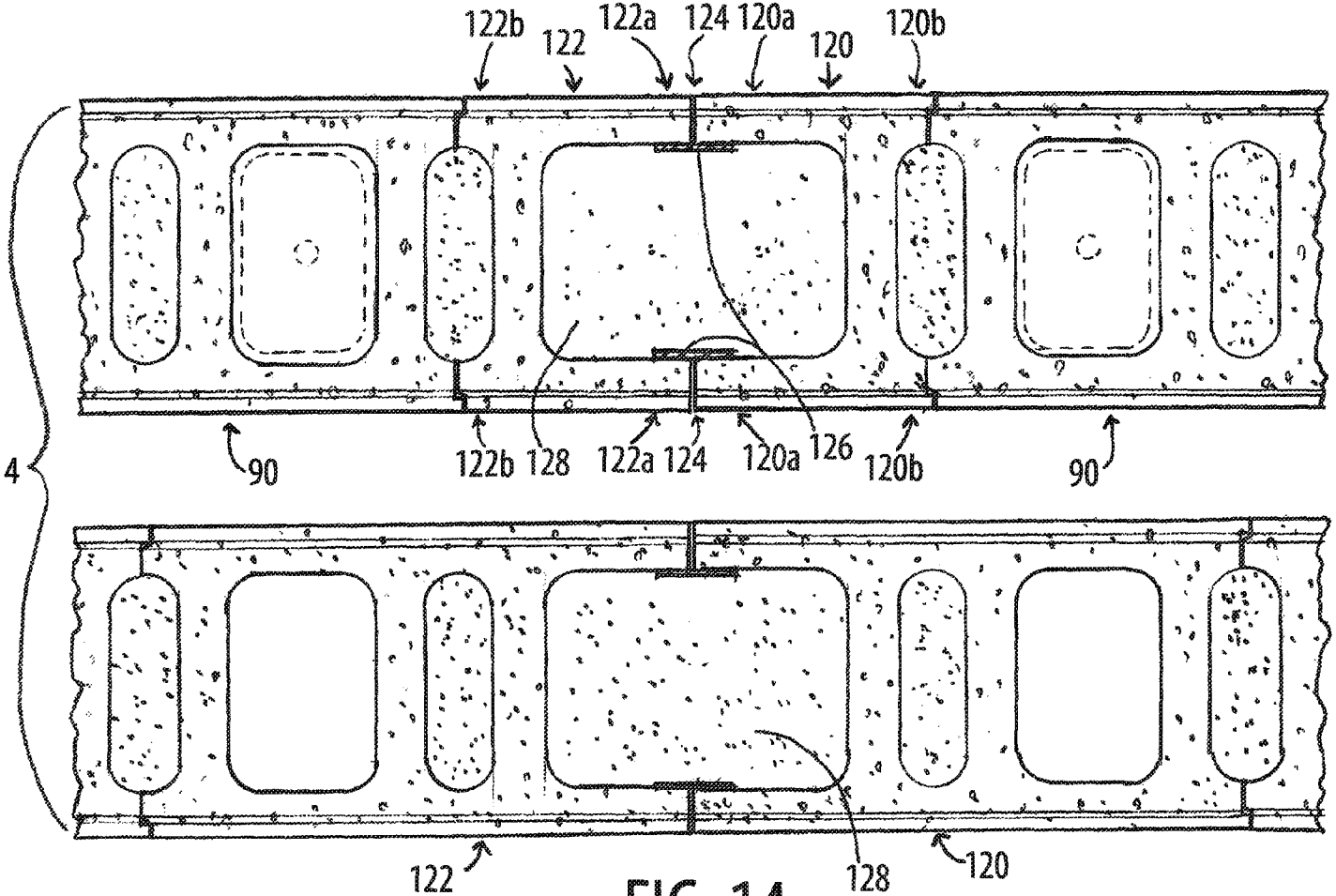
FIG. 14 is an enlarged plan view similar to FIG. 8 illustrating the use of cut blocks according to still another aspect of the present invention at an intermediate portion of a wall.
Figure 14A:
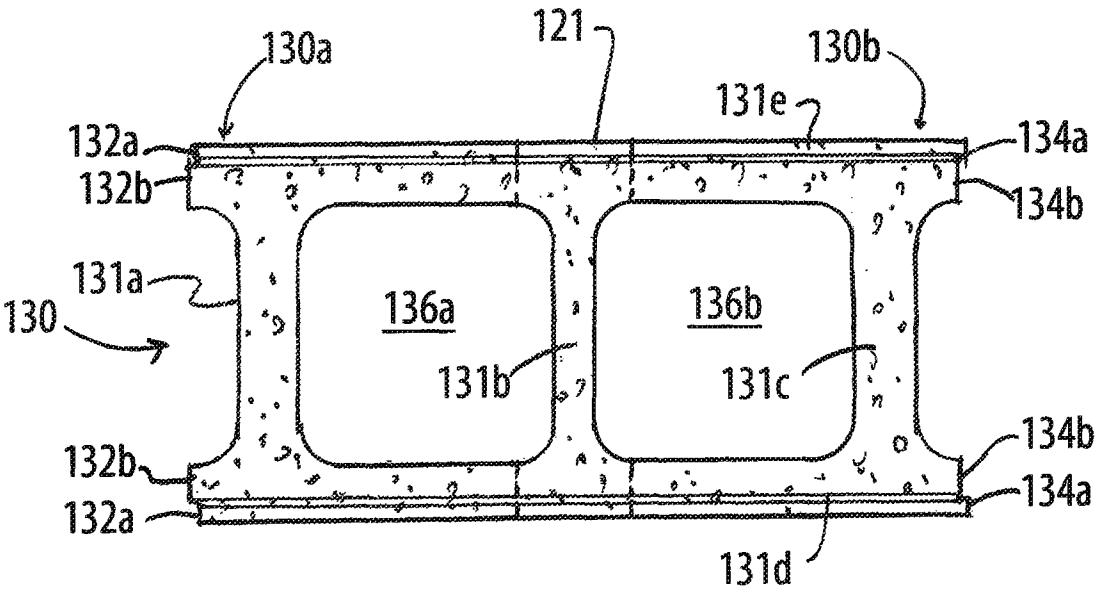
FIG. 14A is a plan view of a stretcher block from which the cut blocks of FIG. 14 are obtained.

During construction, the overall length of the wall likely will not be an integral multiple of the length of a block 90, thereby resulting in a need for a block that is shorter in length than a block 90 to fill a like-sized gap. The gap may be filled with first and second cut pieces 120, 122 as shown in FIG. 14. The cut pieces 120, 122 may be formed by cutting and removing a central section 121 of a stretcher block 130 as seen in FIG. 14A. Alternatively, the cut pieces 120, 122 may be cut from two different blocks and/or may be formed by cutting and/or removing other section(s) of one or more blocks. Once positioned in the course, the separate pieces form a pair of mid-joints 124 where planar vertical edges 120*a*, 122*a* abut. A length of flashing 126 having upper and lower ends is placed along each mid-joint 124 on the interior of the cut pieces 120, 122. The upper and lower ends of each length of flashing 126 may wrap around the lower and upper surfaces 32, 33 of the front and/or rear face at each mid-joint 124. If desired, the flashing may be secured in place by any suitable means, such as adhesive caulk, and/or the void 128 formed by the cut pieces 120, 122 may be filled with cementitious material. The flashing may be made of any suitable material, such as butyl rubber.

Referring to FIG. 14A, the stretcher block 130 includes three webs 131*a*-131*c* that extend between front and rear faces 131*d*, 131*e* wherein the front and rear faces include shouldered vertical edge portions 132, 134. The webs and the front and rear faces 131*a*-131*e* define two voids 136*a*, 136*b* within each block 130. Similar or identical to the block 90 the shouldered vertical edge portions of the stretcher block 130 include shoulders 132*a*, edge portions 132*b*, and protrusions 134*a* defining a recess 134*b*. The stretcher block 130 is primarily intended to be cut to form cut pieces 120, 122 as noted previously, although the block 130 may be used as field blocks in a wall construction with similar or identical blocks or any of the other blocks described herein, if desired.

During construction, the corner blocks 113 are first positioned atop the leveling course to begin a first field course. The user then lays a plurality of field blocks 90 from each corner block 113 toward the middle of the course. The course is laid in a manner such that some, if not all, voids in the blocks of the course being laid are aligned with voids in the leveling course. Inserts 106 are placed in some or all of the voids 98 atop the ledges 104 and vertical rebar 46 is placed in some or all of the voids 96, 98, as desired. If a gap is formed between laterally spaced blocks at the middle of the wall, two cut pieces 120, 122 are cut to length in the field. Before laying the cut pieces 120, 122, lower ends 126*a* of two lengths of flashing 126 are placed on the top surface 33 of the lower block 90. The cut pieces 120, 122 are then placed atop the lower ends 126*a* of the flashing 126 and lower block 90. The flashing lengths 126 are then bent upwardly and laid over the top surface 33 of the cut pieces 120, 122 at the mid-joints 124 (with or without adhesive caulk securing the lengths to the cut pieces 120, 122, as noted above) and the void 128 formed by the cut pieces 120, 122 may be filled with cementitious material.

In laying a second field course above the first field course, corner blocks 113 are first positioned perpendicular to and atop a portion of the corner blocks 113 of the first field course. It should be noted that the first and second field courses and subsequent courses are arranged to maintain a running bond or other pattern throughout the wall. A plurality of blocks 90 is laid starting from the corner blocks 113 toward the middle of the course. Inserts 106 are placed on the ledges 104 in the voids of one or more blocks 90. Vertical rebar 46 may be inserted through the insert 106 and be supported thereby in an upright position or may extend through a plurality of inserts in aligned voids 98. Other vertical rebar may be placed in aligned voids 96 and retained and/or supported therein by any suitable means, if desired. Before or after placing an upper block atop a lower block, as noted above, an amount of cementitious material may be placed atop the insert 106 of a lower block 90. Similar to the course below, two cut pieces 120, 122 may be cut to length in the field if a gap is formed in an interior portion of the wall (i.e., at a location spaced from the corners of the wall). Cut pieces 120, 122 may vary in length so as to maintain the running bond or other pattern throughout the wall. Lengths of flashing 126 are disposed along the mid-joint 124 between the pieces 120, 122 and may be secured in place, as noted previously. The void 128 formed by the cut pieces 120, 122 may be filled with cementitious material. Frangible portions 112 may be removed and horizontal rebar may be placed in the resulting channels. Cementitious material may be placed in one or more of the voids 96, 98 to cover the horizontal rebar. Remaining courses are laid atop one another in a similar or identical fashion.

Figure 15:
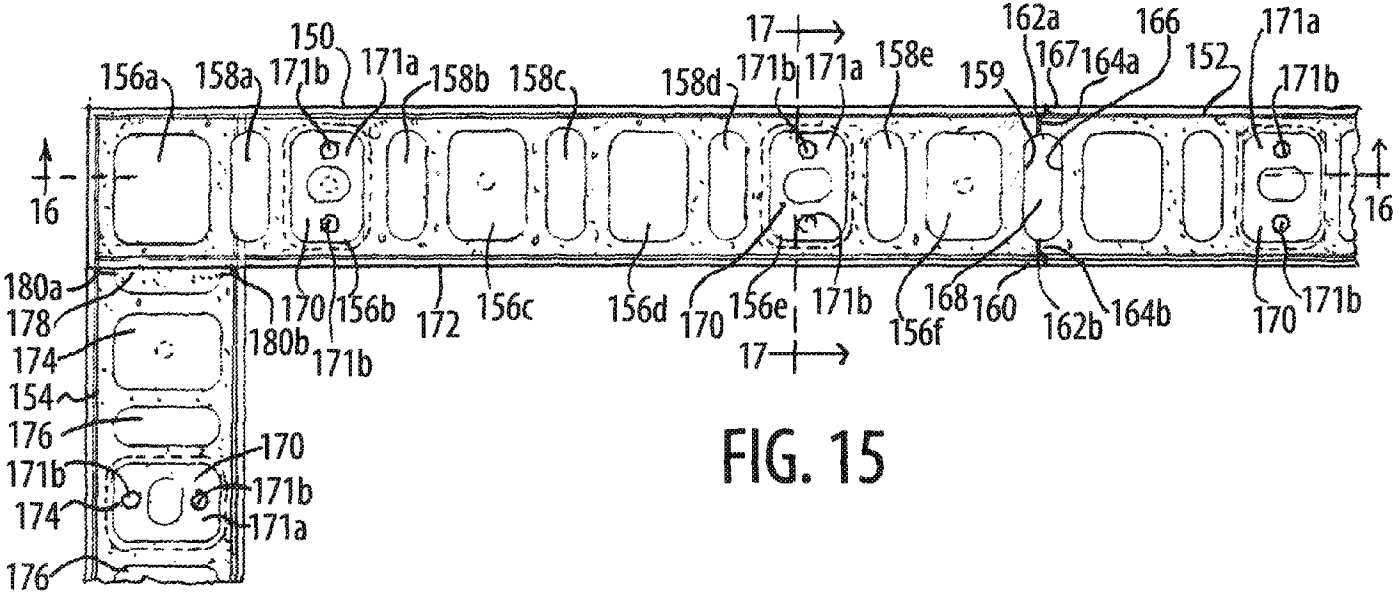
FIGS. 15, 16, 17, and 18 are views similar to FIGS. 1, 2, 3, and 6, respectively, illustrating leveling and field blocks according to yet another aspect of the present invention.
Figure 16:
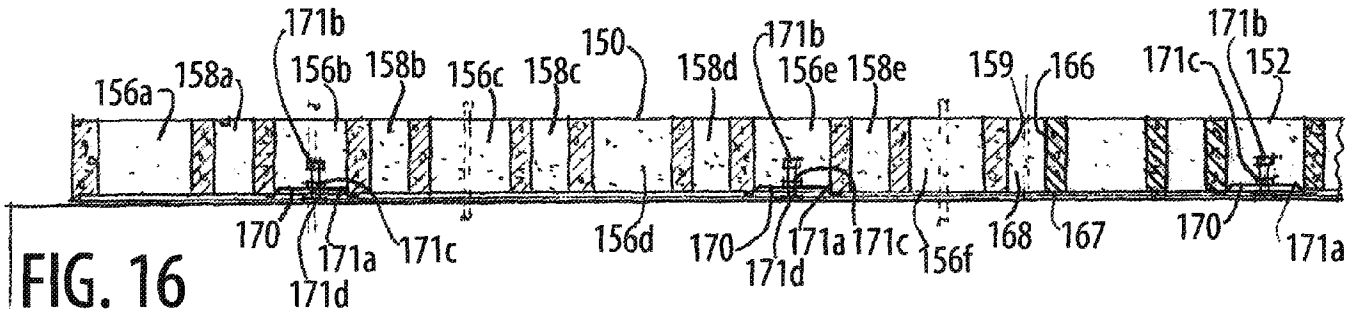
Figure 17:
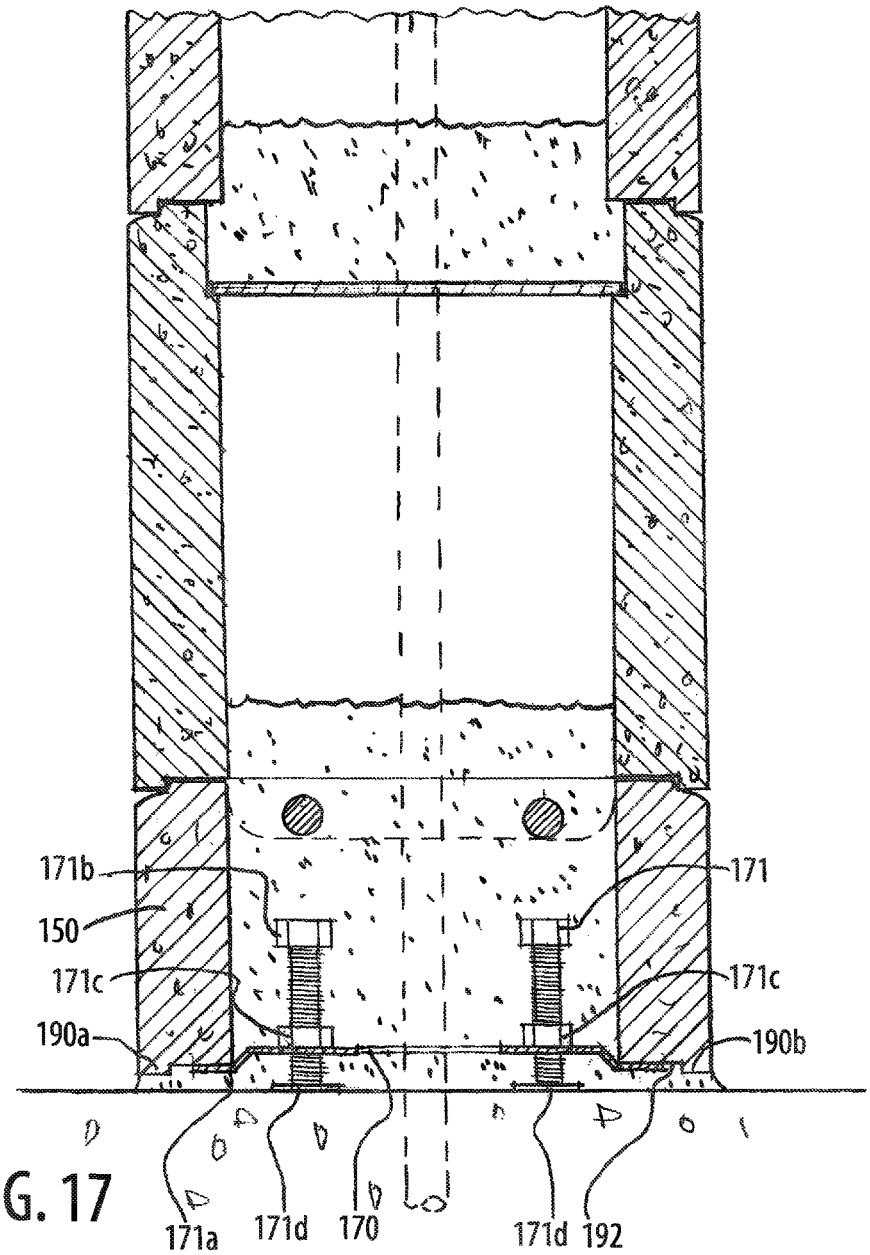

FIGS. 15-17 illustrate a course of alternative leveling blocks that may be used with the blocks 70 and/or 90 to construct a wall. In particular, a corner block 150 is joined to main leveling blocks 152, 154 similar or identical to the blocks 10 and 11 described above. The blocks 150-154 are of overall dimensions similar or identical to the leveling blocks 10, 11, and in the illustrated embodiment, each is 32"-48" in length, although the length and/or other dimensions may vary. Each of the blocks 150-154 includes large and small voids of dimensions, shapes, and spacing similar or identical to the voids 96 and 98 of the block 90. For example, the block 150 includes large voids 156*a*-156*f* and small voids 158*a*-158*e*. An end void 159 is located at an end 160 of the leveling block 150. Also located at the end 160 is a pair of protrusions 162*a*, 162*b* defining a recess. Shoulders 164*a*, 164*b* of the adjacent block 152 in part define an end void 166 located at an adjacent end 167 of the block 152. The end void 166 is aligned with the end void 159. The end voids 159, 166 together define a void 168 of similar or identical shape and dimensions to the voids 158, and are further preferably of similar or identical shape and dimensions to the voids 96 of the blocks 90.

Leveling components 170 similar or identical to the leveling component 16 of FIGS. 1-3 are disposed within selected voids 156, for example, the voids 156*b* and 156*e* of the leveling block 150, and are in engagement with surfaces defining the voids 156*b*, 156*e*. Each of the leveling components 170 includes a leveling plate 171*a* that may be secured to the walls defining the voids 156*b*, 156*e* or such walls may simply rest on outer margins of the plates 171*a*. As in the previous embodiment of FIGS. 1-3, the leveling components 170 include threaded adjuster bolts 171*b* that extend through threaded bores of nuts 171*c* (seen particularly in FIGS. 16 and 17) that are welded or otherwise secured to the plates 171*a*. The nuts 171*c* are aligned with holes in the plate 171 and the bolts 171*b* further extend through the holes in the plate 171*a* and can be rotated to permit leveling of the block 150. Also as in the previous embodiment of FIGS. 1-3, washers 171*d* may be rotatably or stationarily secured to a lower end of the bolts 171*b*. The blocks 152 and 154 (and other leveling blocks not shown) also include identical or similar leveling components 170 in corresponding selected voids therein to permit leveling of same.

If desired, the leveling components shown in FIGS. 21 and 22 may be used in place of the leveling components shown in FIGS. 15-17.

The block 154 (FIG. 15) abuts a side surface 172 of the leveling lock 150 and includes large and small voids 174, 176, respectively, similar or identical in size, shape, and/or spacing to the voids 156, 158 of the block 150, as noted above. An end void 178 is disposed adjacent the side surface 172 of the block 150. Protrusions similar or identical to the protrusions 162*a*, 162*b* may be included at the end of the block 152 in contact with the side surface 172 or the protrusions may be omitted, in which case flat faces 180A, 180B may be disposed in contact with the side surface 172. The leveling blocks 150, 152, and 154 and remaining leveling blocks of the course may be secured together by placing cementitious material (e.g., grout) in the voids 178, 156, 168 and in corresponding voids of other leveling blocks and/or additional such material may be placed in any or all of the other voids of the leveling blocks.

As seen in FIG. 17, each leveling block, for example, the leveling block 150, includes downwardly projecting shoulders 190*a*, 190*b* that permit the leveling blocks to be used in a leveling course atop one or more courses of blocks 70, 90 in an interlocking fashion. The shoulders 190*a*, 190*b* define a recess 192 within which is received the protrusions 33*a* of the blocks 70 and/or 90 when the leveling blocks are laid atop the blocks 70 and/or 90.

Preferably, the voids 156 are of approximately the same size and shape as the voids 98 of the blocks 90. Also preferably, the voids 156, 158 are spaced from one another by equal distances and such distances are substantially equal to the distances between the voids 96 and 98 of the blocks 90. This permits the leveling blocks 150-154 to serve as one or more leveling course(s) and the blocks 90 to be used as field blocks atop and with the leveling blocks 150-154 in a wall with voids 96, 98, of the blocks 90 of different courses being aligned with one another and being aligned with voids 158, 156, respectively of the leveling blocks 150-154. This alignment permits plugs to be formed and rebar to be inserted in aligned voids as noted above.

Means may be provided at the corner blocks of any of the embodiments disclosed herein to permit tight and level interfitting of the blocks notwithstanding the use of protrusions 33*a* that extend into the recess 32*a* of the block next higher course. With reference to FIG. 7A, according to a first aspect, such means comprises a groove 220, which, in the illustrated embodiment, is formed in an upper surface of the corner first high horizontal block 70-1*a*, and which is aligned with an inner shouldered portion 33*b* of the adjacent block 70-2. This alignment permits a further corner block (not shown) to be overlaid on and spanning the blocks 70-1 and 70-2 such that the spaced elongate shoulders 32*b* rest on level surfaces of the shouldered portion 33*b* of the blocks 70-1 and 70-2. This aspect is further illustrated in FIG. 12, in which a groove 113*a* is formed in a corner block 113 and is placed in alignment with an inner shouldered portion 33*b* of an adjacent block 90.

Figure 12A:
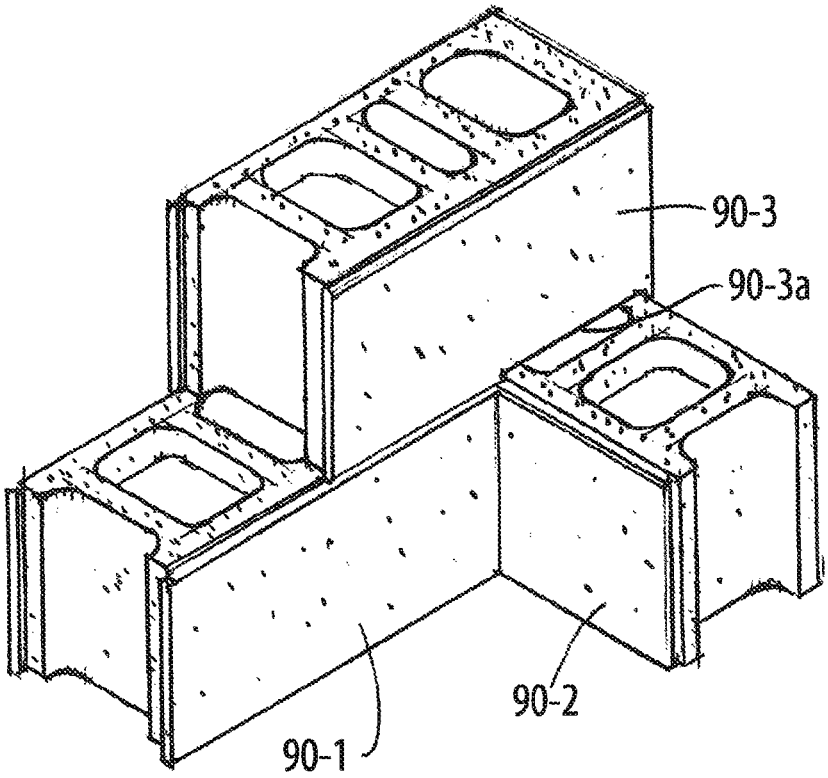
FIG. 12A is a fragmentary isometric view of a portion of a corner of a wall constructed using a corner block according to another aspect of the present invention.

A further arrangement alternate to that shown in FIG. 7A is illustrated in FIG. 12A in connection with a corner formed by corner blocks 90-1 through 90-3, which are otherwise constructed in accordance with the embodiment of FIG. 12 et seq. The corner portion shown in FIG. 12A comprises perpendicular blocks 90-1 and 90-2. The block 90-3 partially overlies the blocks 90-1 and 90-2 and is perpendicular to the latter block. A cut out or recess 90-3*a* is formed at manufacture of the block 90-3 or in the field to remove a length of one of the spaced elongate shoulder 32*b* (i.e., an appropriate length of the inner elongate shoulder 32*b*) such that the protrusions 33*a* do not prevent the block 90-3 from resting in level fashion on the block 90-2. Of course, any combination of grooves, removed or added portions, or the like can be provided to maintain a level condition of corner blocks, as desired.

The front and rear faces of any of the blocks disclosed herein may be glazed, ground, formed or otherwise manufactured and/or treated to achieve a desired outward appearance. For example, the front and/or rear faces may be manufactured or treated to have a split face appearance, a roughened, pebble-like, or lined appearance, a glazed appearance, a distressed appearance, etc.

Alternatively, in a further embodiment of a block profile shown in FIG. 22, the top surface 22 of the block 10, 11 may be curved along the block profile to allow front-to-back leveling of a wall during assembly thereof. The inner edges of front and rear faces along the top surface 22 of the leveling block 10, 11 arch downwardly toward the respective outer edges to form a convex curve. The bottom surface 32 of the field block 30 of the second course has a corresponding concave curve to receive the top surface 22 of the adjacent lower block. The bottom surfaces of the front surface 11*a* and the rear surface 11*b* of the leveling block 10, 11 may be fully planar or include recesses 32*a* and elongate shoulders 32*b* to receive the flanges of the threaded leveling components 16. If a leveling or other block that has already been fixed in place is tilted in the direction perpendicular to the length (i.e., along the width) of the block, the subsequent (i.e., overlying) block and/or partial or entire course (or courses) can be positioned inwardly toward the front surface or outwardly toward the rear surface so that the wall can be restored during assembly thereof to a plumb condition.

As in the above embodiment, corner blocks of the embodiment of FIG. 22 may have portions removed therefrom to permit perpendicularly-disposed overlying blocks to fit in level fashion atop one another.

Other embodiments of the disclosure including all the possible different and various combinations of the individual features (including elements and process steps) of each of the foregoing described embodiments and examples are specifically included herein.

INDUSTRIAL APPLICABILITY

The wall construction system described herein advantageously allows for easy assembly of level and plumb courses of wall blocks without the need to position blocks during assembly using mortar. The resulting wall can be quickly assembled by a relatively untrained worker and is strong and attractive in appearance.

Numerous modifications to the present disclosure will be apparent to those skilled in the art in view of the foregoing description. Accordingly, this description is to be construed as illustrative only and is presented for the purpose of enabling those skilled in the art to make and use the present disclosure and to teach the best mode of carrying out same.

I claim:

1. A wall construction block combination, comprising a block comprising:

a front surface, a back surface, an upper surface, a lower surface, and a plurality of webs extending between the front surface and the back surface to define at least one void with a void perimeter, wherein the at least one void is at least partially bounded by a ledge within the void and along the void perimeter and wherein the front surface and the back surface have first vertical ends and second vertical ends opposite the first vertical ends;

a first plurality of structures on the first vertical ends defining an interior protrusion and a shoulder; and a second plurality of structures on the second vertical ends defining an outer protrusion and a recess;

wherein the interior protrusions of the first vertical ends are dimensioned to have an interfitting relationship with the recess on the second vertical ends of a substantially identical adjacent wall construction block and wherein a channel is defined that extends in a height direction and is adapted to channel a fluid; and an insert separate from the block and disposed on the ledge, the insert having a surface area dimensioned to have a portion of its perimeter supported by the ledge.

2. The wall construction block combination of claim 1, wherein the upper surface interfits with a lower surface of an adjacent wall construction block arranged atop the wall construction block.

3. The wall construction block combination of claim 2, wherein the front surface and the back surface have an interior edge adjacent the at least one void and an exterior edge opposite the interior edge, and wherein at least an outer portion of the upper surface slopes downwardly toward the exterior edge.

4. The wall construction block combination of claim 1, further comprising a plug of cementitious material formed atop the insert.

5. The wall construction block combination of claim 4, wherein the plug extends upwardly into a void of an adjacent wall construction block arranged atop the wall construction block.

* * * * *